US006750840B2

(12) United States Patent
Morita

(10) Patent No.: US 6,750,840 B2
(45) Date of Patent: Jun. 15, 2004

(54) ELECTRO-OPTICAL DEVICE, METHOD OF DRIVING THE SAME AND ELECTRONIC INSTRUMENT

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 224 days.

(21) Appl. No.: 09/953,092

(22) Filed: Sep. 13, 2001

(65) Prior Publication Data

US 2002/0075219 A1 Jun. 20, 2002

(30) Foreign Application Priority Data

Sep. 13, 2000 (JP) ..... 2000-277811

(51) Int. Cl.[7] ..... G09G 3/30; G09G 3/36

(52) U.S. Cl. ..... 345/100; 345/78; 345/87; 345/89; 345/98

(58) Field of Search ..... 345/87, 89, 90, 345/96, 98, 99, 100, 103, 211, 76–84; 315/169.3

(56) References Cited

U.S. PATENT DOCUMENTS

| | | | | | |
|---|---|---|---|---|---|
| 4,750,813 | A | * | 6/1988 | Ohwada et al. | 345/87 |
| 5,625,373 | A | * | 4/1997 | Johnson | 345/58 |
| 5,877,737 | A | * | 3/1999 | Kim et al. | 345/89 |
| 5,940,055 | A | * | 8/1999 | Lee | 345/87 |
| 6,177,917 | B1 | * | 1/2001 | Koizumi et al. | 345/87 |
| 6,246,385 | B1 | * | 6/2001 | Kinoshita et al. | 345/87 |

* cited by examiner

*Primary Examiner*—Regina Liang
*Assistant Examiner*—Duc Q Dinh
(74) *Attorney, Agent, or Firm*—Hogan & Hartson, LLP

(57) ABSTRACT

An electro-optical device comprises a scan-line drive circuit which supplies a scan signal to a plurality of scan lines for selecting one of the scan lines; a data-line drive circuit which supplies a data signal to a plurality of data lines; and a voltage transformation circuit which changes a voltage of the data signal supplied from the data-line drive circuit based on a distance between the data-line drive circuit and one of the scan lines which has been sequentially selected by the scan-line drive circuit.

29 Claims, 21 Drawing Sheets t1
t2
τ
τa
V1
Y1
tb1
tb2
V2
V1
Cb
Y200
tc1
tc2
V3
V2
V1
Cc
Y400

ELECTRO-OPTICAL DEVICE, METHOD OF DRIVING THE SAME AND ELECTRONIC INSTRUMENT

Japanese Patent Application No. 2000-277811, filed Sep. 13, 2000, is hereby incorporated by reference in its entirety.

BACKGROUND OF THE INVENTION

1. Field of the Invention

The present invention relates to an electro-optical device, a method of driving the electro-optical device and an electronic instrument.

2. Description of Related Art

In an active matrix type TFT (Thin Film Transistor) liquid crystal device, for example, a data-line drive circuit converts RGB data to an analog signal which is in turn supplied to a plurality of data lines in the liquid crystal panel as data signal voltage. The individual pixels that correspond to selected scan lines are charged with the data signal voltage that is supplied to each of the data lines from the data-line drive circuit. The liquid crystal device selects a scan line from one that is, for example, closer to the data line drive circuit in one frame period. In this case, the closer to the end of the frame period, the farther the distance from the data-line drive circuit to a pixel to be charged becomes. This is more prominent as the liquid crystal screen gets larger.

Particularly, as the liquid crystal panel of the liquid crystal device becomes larger, the interconnection resistance and the interconnection capacitance become greater, thus increasing the influence of the interconnection delay on the supply of the data signal voltage to the data lines.

FIG. 21A shows a simple T type or $\pi$ type model of the interconnection delay. The model in FIG. 21A includes a power source 300 equivalent to the data-line drive circuit of a liquid crystal device, a line L equivalent to a data line and having parasitic resistances R1 to R3 and parasitic capacities $C_1$ to $C_3$ of the data line and pixels.

FIG. 31B shows chronological changes in voltages charged in the capacitors $C_1$ to $C_3$ respectively connected to points $P_1$ to $P_3$ when a voltage is supplied to the line L from the power source 300. As the capacitor $C_1$ at the point $P_1$ is located closest to the power source 300, the capacitor $C_1$ is charged rapidly. The voltage of the capacitor $C_1$ can therefore reach a required voltage $V_1$ at time $t_a$ in a predetermined period from $t_1$ to $t_2$. As the capacitor $C_3$ at the point $P_3$ is located farthest to the power source 300, by way of contrast, the capacitor $C_3$ demonstrates a charge characteristic of a gentle slope. Therefore, the voltage of the capacitor $C_3$ cannot reach the required voltage $V_1$ in the predetermined period from $t_1$ to $t_2$ but reaches it only at time $t_c$.

This model can be applied to a liquid crystal device so that the liquid crystal device according to the related art has to face such a problem that a selected pixel cannot be charged to a predetermined voltage within a predetermined period.

SUMMARY OF THE INVENTION

The present invention is devised in the light of the above problems and has as an objective thereof the provision of an electro-optical device capable of charging a selected pixel to a predetermined voltage within a predetermined time period, a method of driving the electro-optical device and an electronic instrument.

According to a first aspect of the present invention, there is provided an electro-optical device for supplying a voltage to a plurality of pixels and charging the pixels to a predetermined voltage within a predetermined charge period, the pixels being formed of an electro-optical material and provided to correspond to intersections of scan lines and data lines, the electro-optical device includes a scan-line drive circuit which supplies a scan signal to each of the scan lines for selecting one of the scan lines; a data-line drive circuit which supplies a data signal to each of the data lines; and a voltage transformation circuit which changes a voltage of the data signal supplied from the data-line drive circuit based on a distance between the data-line drive circuit and one of the scan lines which has been sequentially selected by the scan-line drive circuit.

According to a second aspect of the invention, there is provided an electro-optical device for supplying a voltage to a plurality of pixels and charging the pixels to a predetermined voltage within a predetermined charge period, the pixels being formed of an electro-optical material and provided to correspond to intersections of scan lines and data lines, the electro-optical device includes a scan-line drive circuit which supplies a scan signal to each of the scan lines for selecting one of the scan lines; a first data-line drive circuit which supplies a first data signal to one end of each of the data lines; a second data-line drive circuit which supplies a second data signal to the other end of each of the data lines; and a circuit which causes the second data-line drive circuit to supply the second data signal to each of the data lines in synchronism with the supply of the first data signal to each of the data lines.

According to a third aspect of the present invention, there is provided an electro-optical device for supplying a voltage to a plurality of pixels and charging the pixels to a predetermined voltage within a predetermined charge period, the pixels being formed of an electro-optical material and provided to correspond to intersections of scan lines and data lines, the electro-optical device includes a scan-line drive circuit which supplies a scan signal to each of the scan lines for selecting one of the scan lines; a first data-line drive circuit which supplies a first data signal to one end of each of the data lines; a second data-line drive circuit which supplies a second data signal to the other end of each of the data lines; and a voltage transformation circuit which changes a voltage of the second data signal supplied from the second data-line drive circuit based on a distance between the first data-line drive circuit and one of the scan lines which has been sequentially selected by the scan-line drive circuit.

BRIEF DESCRIPTION OF THE DRAWINGS

FIG. 10A is a diagram showing a buffer circuit and FIG. 18B is a cross-sectional view of an inverter;

DETAILED DESCRIPTION OF THE EMBODIMENTS

Figure 1:
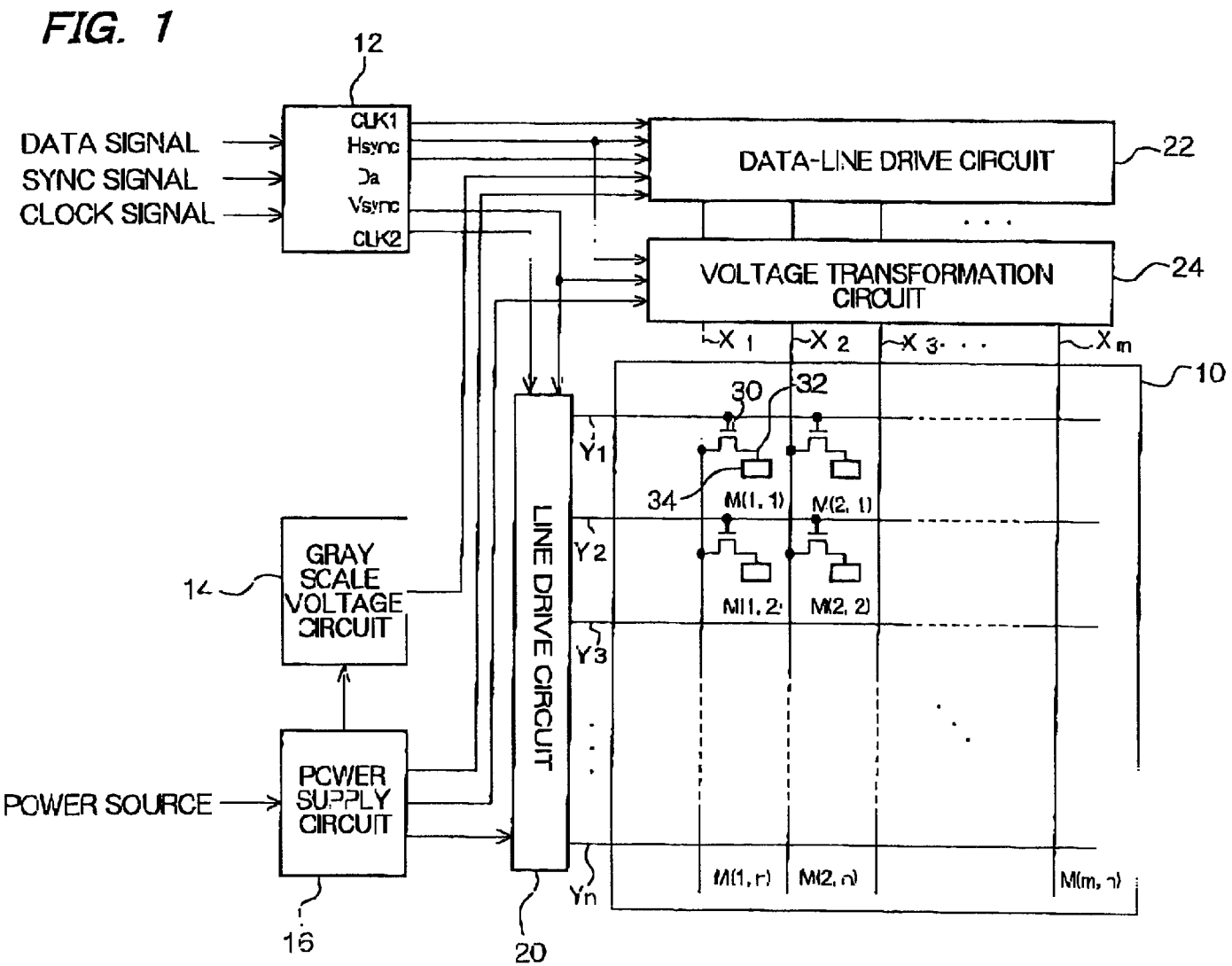
FIG. 1 is a diagram illustrating a liquid crystal device according to a first embodiment of the invention.

An electro-optical device according to one embodiment of the invention supplies a voltage to a plurality of pixels and charges the pixels to a predetermined voltage within a predetermined charge period, the pixels being formed of an electro-optical material and provided to correspond to intersections of scan lines and data lines, and the electro-optical device includes a scan-line drive circuit which supplies a scan signal to each of the scan lines for selecting one of the scan lines; a data-line drive circuit which supplies a data signal to each of the data lines; and a voltage transformation circuit which changes a voltage of the data signal supplied from the data-line drive circuit based on a distance between the data-line drive circuit and one of the scan lines which has been sequentially selected by the scan-line drive circuit.

According to the electro-optical device and a method of driving the electro-optical device, the voltage transformation circuit can change the voltage of the data signal supplied to each pixel corresponding to the selected scan line during one frame period, based on the charge characteristic that depends on the distance between the selected scan line and the data-line drive circuit. This can overcome the problems such that pixels cannot be charged sufficiently within a selection period due to the parasitic resistance and parasitic capacity.

The voltage transformation circuit may include:

a transformation-period determination circuit which determines a transformation period in which the voltage of the data signal from the data line drive circuit is changed, within the charge period;

a voltage generation circuit which generates a voltage; and a voltage addition circuit which adds the voltage generated by the voltage generation circuit to the voltage of the data signal supplied from the data-line drive circuit within the transformation period.

With this structure, the voltage transformation circuit can change the voltage of the data signal supplied from the data-line drive circuit within the charge period.

The transformation-period determination circuit may include:

a first constant current source;

a first capacitor which has one end connected to the first constant current source and the other end connected to a terminal having an arbitrary potential;

a first switching element connected in parallel to the first capacitor; and a first buffer having an input terminal connected between the first constant current source and the first capacitor, wherein the first switching element is closed in synchronism with the end of the charge period to discharge the first capacitor;

wherein the first switching element is opened in synchronism with a start of the charge period to charge the first capacitor; and wherein the transformation period is determined based on a logical output of the first buffer.

This transformation-period determination circuit can determine the transformation period in which the data signal voltage is changed, even during the charge period (or a selection period).

In this electro-optical device, the transformation-period determination circuit may change the transformation period.

By changing the charge characteristic of each selected pixel in this way, the charge characteristic can be more improved.

In the electro-optical device, the data signal having a higher voltage boosted by the voltage transformation circuit may be supplied to each of the data lines when the distance between the data-line drive circuit and one of the scan lines selected by the scan-line drive circuit is longer.

By applying a higher voltage to the pixel corresponding to the selected scan line in the transformation period within the selection period when the distance between the selected scan line and the data-line drive circuit becomes longer, it is possible to overcome the problem that the pixels cannot be charged sufficiently within the selection period due to the parasitic resistance and parasitic capacity.

The voltage generation circuit may include:

a second constant current source;

a second capacitor which has one end connected to the second constant current source and the other end connected to a terminal having an arbitrary potential; and a second switching element connected in parallel to the second capacitor, wherein the voltage addition circuit adds a voltage of the second capacitor to the voltage of the data signal supplied every charge period from the data-line drive circuit.

This voltage generation circuit can generate a voltage to be linearly charged in the second capacitor. By adding the linearly boosted voltage to the voltage of the original data signal when the distance between a selected scan line and the data-line drive circuit becomes longer, the voltage of the data signal that has been boosted more adequately can be supplied to each data line.

In the electro-optical device, the voltage addition circuit may include a circuit which converts the voltage of the second capacitor with an arbitrary function.

By converting the voltage of the second capacitor with an arbitrary function and then adding that voltage to the voltage of the data signal, it is possible to more appropriately overcome the problem that the pixels cannot be charged sufficiently within the selection period due to the parasitic resistance and parasitic capacity.

In the electro optical device, the arbitrary function may be a function of the voltage of the data signal supplied from the data-line drive circuit.

In this case, a voltage boosted in relative to the voltage of the original data signal is added to the latter voltage. The use of the voltage of the original data signal as an arbitrary function enables the electro-optical device to generate the voltage of the data signal that has been boosted more adequately.

The electro-optical device may further comprise:

a counter which counts a plurality of scan lines which have been selected within one frame period by the scan-line drive circuit, wherein the voltage transformation circuit changes the voltage of the data signal supplied from the data-line drive circuit, based on a value counted by the counter.

With this structure, the voltage transformation circuit can change the voltage of the data signal supplied from the data-line drive circuit based on the value of the counter.

The electro-optical device may further comprise a measuring circuit which measures elapsed time every one frame period, wherein the measuring circuit includes:

a third constant current source;

a third capacitor which has one end connected to the third constant current source and the other end connected to a terminal having an arbitrary potential;

a third switching element connected in parallel to the third capacitor; and a second buffer having an input terminal connected between the third constant current source and the third capacitor, wherein the third switching element is closed in synchronism with the end of one frame period to discharge the third capacitor;

wherein the third switching element is opened in synchronism with a start of one frame period to charge the third capacitor; and wherein the voltage transformation circuit changes the voltage of the data signal supplied from the data-line drive circuit, based on a logical output of the second buffer.

With the structure, based on the timing at which the logical output of the third buffer changes, the voltage transformation circuit can change the voltage of the data signal within one frame period.

In the electro-optical device, the measuring circuit may include a plurality of third buffers connected in parallel with the input terminal as a common end; wherein the third buffers may have different switch timings for logical outputs; and wherein the voltage transformation circuit may change the voltage of the data signal supplied from the data-line drive circuit, based on each of the logical outputs of the third buffers.

With the structure, the measuring circuit can set different timings at which logical outputs of the buffers are changed. Based on the these timings, the voltage transformation circuit can change the voltage of the data signal applied before and after each timing.

In the electro-optical device, the scan-line drive circuit may comprise a plurality of integrated circuits (ICs) for scan-line drive; and the voltage transformation circuit may change the voltage of the data signal supplied from the data-line drive circuit of each of the ICs for scan-line drive.

Even if the scan-line drive circuit comprises the ICs for scan line drive, the voltage of the data signal supplied from the data-line drive circuit can be changed for each of the ICs for scan-line drive.

According to another embodiment of the present invention, there is provided an electro-optical device for supplying a voltage to a plurality of pixels and charging the pixels to a predetermined voltage within a predetermined charge period, the pixels being formed of an electro-optical material and provided to correspond to intersections of scan lines and data lines, the electro-optical device includes a scan-line drive circuit which supplies a scan signal to each of the scan lines for selecting one of the scan lines; a first data-line drive circuit which supplies a first data signal to one end of each of the data lines; a second data-line drive circuit which supplies a second data signal to the other end of each of the data lines; and a circuit which causes the second data-line drive circuit to supply the second data signal to each of the data lines in synchronism with the supply of the first data signal to each of the data lines.

This electro optical device and a method of driving the electro-optical device can supply the data signal voltage from both ends of each data line of an electro-optical device, and can overcome the problem that the pixels cannot be charged sufficiently within the selection period due to the parasitic resistance and parasitic capacity.

According to a further embodiment of the present invention, there is provided an electro-optical device for supplying a voltage to a plurality of pixels and charging the pixels to a predetermined voltage within a predetermined charge period, the pixels being formed of an electro-optical material and provided to correspond to intersections of scan lines and data lines, the electro-optical device includes a scan-line drive circuit which supplies a scan signal to each of the scan lines for selecting one of the scan lines; a first data-line drive circuit which supplies a first data signal to one end of each of the data lines; a second data-line drive circuit which supplies a second data signal to the other end of each of the data lines; and a voltage transformation circuit which changes a voltage of the second data signal supplied from the second data-line drive circuit based on a distance between the first data-line drive circuit and one of the scan lines which has been sequentially selected by the scan-line drive circuit.

According to the electro-optical device and a method of driving the electro-optical device, as the distance between the selected scan line and the first data-line drive circuit becomes longer, the voltage supplied from the second data-line drive circuit can be increased. If the distance is short, only the first data-line drive circuit may be driven. The second data-line drive circuit may be driven in case of necessary, and this makes it possible to overcome the problem that the pixels cannot be charged sufficiently within the selection period due to the parasitic resistance and parasitic capacity as well as to reduce the power consumption.

The second data signal may be set to have a lower accuracy of gray scale display in comparison with the first data signal. In this case, the second data line drive circuit performs only rough gray scale display and the first data-line drive circuit performs detailed gray scale display. If the selected pixel is close to the second data-line drive circuit, the second data signal can charge the selected pixel rapidly.

The embodiments of the present invention will now be described with reference to the accompanying drawings.

First Embodiment

FIG. 1 presents a block diagram of a TFT type liquid crystal device according to the first embodiment of the invention.

The liquid crystal device includes a liquid crystal panel 10, a signal control circuit section 12, a gray scale voltage circuit section 14, a power supply circuit section 16, a line drive circuit 20, a data-line drive circuit 22 and a voltage transformation circuit 24.

Pixels formed in the liquid crystal panel 10 are defined by M(1, 1) to M(m, n). The lines that are driven by the line drive circuit 20 are generically denoted by "Y" and the data lines that are driven by the data-line drive circuit 22 are generically denoted by "X". $Y_1$, $Y_2$, . . . , or $Y_0$ is used to point a specific line, while $X_1$, $X_2$, . . . , or $X_m$ is used to point a specific data line, where m and n are natural numbers.

The liquid crystal panel 10 has (m×n) pixels (e.g., m=800 and n=600 in the embodiment). For one pixel M(1, 1), the data line $X_1$ is connected to the source of a thin film transistor (TFT) device 30 and the line $Y_1$ is connected to the gate thereof. The data lines $X_1$ to $X_m$ are driven by the data-line drive circuit 22 and the voltage transformation circuit 24, while the lines $Y_1$ to $Y_n$ are driven by the line drive circuit 20. The drain of the TFT device 30 is provided with a pixel electrode 32. With the pixel electrode 32 serving as one end, a voltage stored in a capacitor 34 is applied to the liquid crystal layer. The capacitor 34 comprises a pixel capacitor connected to the liquid crystal layer and a holding capacitor for holding a voltage. Normally, there is an opposing electrode, though not illustrated, which faces the pixel electrode 32 via the liquid crystal layer.

Formed in the liquid crystal panel 10 are (m×n) pixels that have the same structure as the pixel M(1, 1).

The liquid crystal device in FIG. 1 is externally supplied with power, data signals and sync signals.

The signal control section 12 sends data signals Da, a clock signal CLK1 and a horizontal sync signal Hsync to the data-line drive circuit 22. The data-line drive circuit 22 latches the data signals Da, each of which is an RGB signal of, for example, 8 bits, at the timing of the clock signal CLK1. After one line of data signals Da is latched, the horizontal sync signal Hsync is sent to the data-line drive circuit 22. Based on the horizontal sync signal Hsync, the latched one line of data signals Da is converted to analog signals which are then subjected to impedance conversion. Each resultant signal is supplied to the data line X as a data signal voltage Vd.

The signal control section 12 sends a clock signal CLK2 and a vertical sync signal Vsync to the line drive circuit 20. The line drive circuit 20 sequentially switches a line Y to be selected at the timing of the clock signal CLK2. In a period where a specific line Y is selected, a voltage $V_2$ to enable the gate of the TFT device 30 connected to that line Y is applied. In synchronism with the enabling of the gate, the data signal voltage vd output from the data-line drive circuit 22 is supplied to the data line X. As the vertical sync signal Vsync is supplied to the line drive circuit 20 after one frame period over which all the lines Y of the liquid crystal panel 10 (screen) are scanned, scanning of the lines Y starts again with the top.

The power supply circuit section 16 supplies power to the gray scale voltage circuit section 14, the line drive circuit 20, the data-line drive circuit 22 and the voltage transformation circuit 24.

The voltage transformation circuit 24 will be discussed below with reference to FIGS. 2 and 3.

Figure 2A:
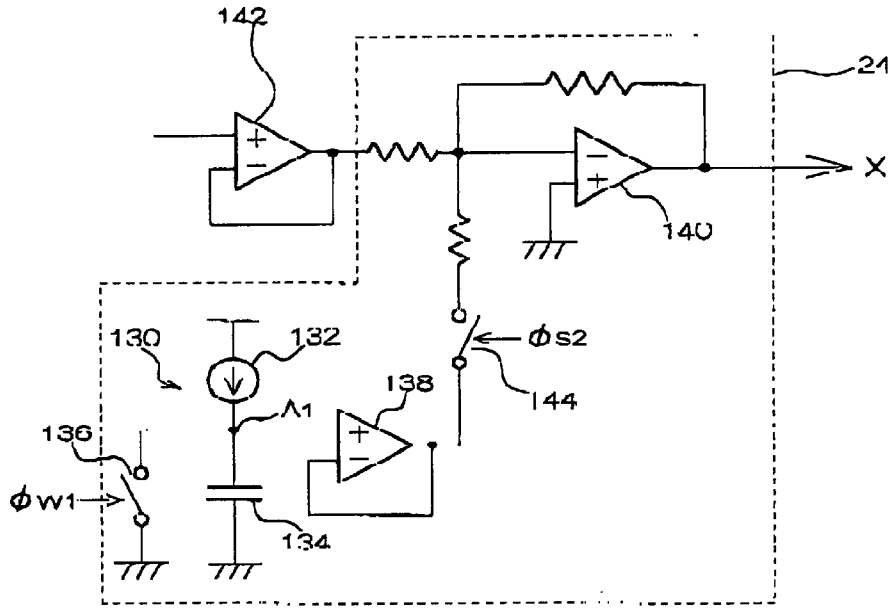
FIG. 2A is a diagram showing a voltage transformation circuit provided in the liquid crystal device in FIG. 1

FIG. 2A shows that the data signal voltage Vd supplied from a voltage follower 142, an internal circuit of the data-line drive circuit 22, is supplied to the data line X via the voltage transformation circuit 24.

The voltage transformation circuit 24 includes a voltage generation circuit 130, an adder 140 and a switching element 144.

The adder 140 outputs the inverted sum of input voltages. The adder 140 adds the voltage of a capacitor 134 having a linear charge characteristic to the original data signal voltage Vd supplied from the data-line drive circuit 22. The period on which the voltage of the capacitor 134 is added is controlled by opening or closing the switching element 144.

The voltage generation circuit 130 includes a constant current circuit 132, the capacitor 134 and a switching element 136 as shown in FIG. 2A. The constant current circuit 132 and the switching element 144 are connected in series to each other via a voltage follower 138. The capacitor 134 and the switching element 136 are connected in parallel to each other with a node $A_1$ as one end. The other ends of capacitor 134 and the switching element 136 are grounded. A signal $\phi_{w1}$ is supplied to the switching element 136 in synchronism with the vertical sync signal Vsync that is supplied every frame period.

Figure 2B:
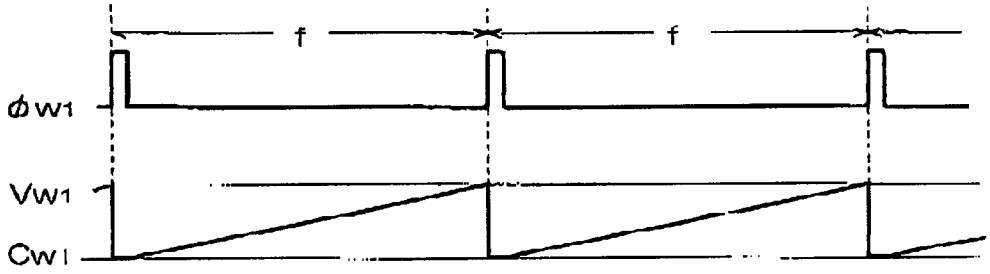
FIG. 2B is a timing chart for explaining the operation of the voltage transformation circuit.

FIG. 2B illustrates a timing chart for the voltage generation circuit 130.

The signal $\phi_{W1}$ supplied based on the vertical sync signal Vsync which corresponds to a frame period f closes the switching element 136, thus discharging charges stored in the capacitor 134. After the discharging, the switching element 136 is opened so that the capacitor 134 is gradually charged in proportional to the time by the constant current circuit 132 as indicated by a waveform $C_{W1}$. The capacitor 134 demonstrates such a charge characteristic that it is charged from a voltage of 0 to a voltage $V_{W1}$ in one frame period f.

The switching element 144 is constituted by, for example, a P channel MOS (PMOS) transistor. The ON/OFF action of the switching element 144 is controlled by a measuring circuit 150 as shown in FIG. 3.

Figure 3A:
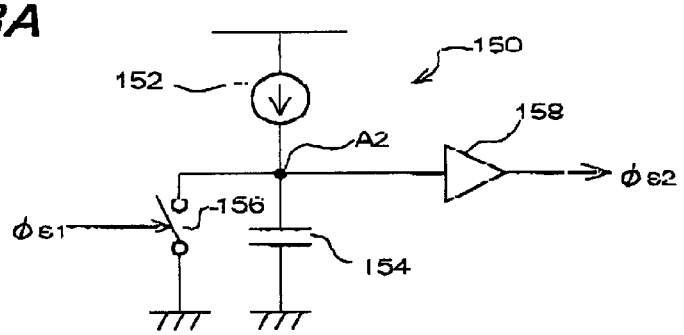
FIG. 3A is a diagram showing a measuring circuit provided in the voltage transformation circuit in FIG. 1

As shown in FIG. 3A, the measuring circuit 150 includes a constant current circuit 152, a capacitor 154, a switching element 156 and a buffer circuit 158. In the measuring circuit 150, the constant current circuit 152 and the buffer circuit 158 are connected in series to each other. The capacitor 154 and the switching element 156 are connected in parallel to each other with a node $A_2$ therebetween serving as one end. The other ends of capacitor 154 and the switching element 156 are grounded. A signal $\phi_{S1}$ is supplied to the switching element 156 in synchronism with the horizontal sync signal Hsync that is supplied to the measuring circuit 190 every selection period.

Figure 3B:
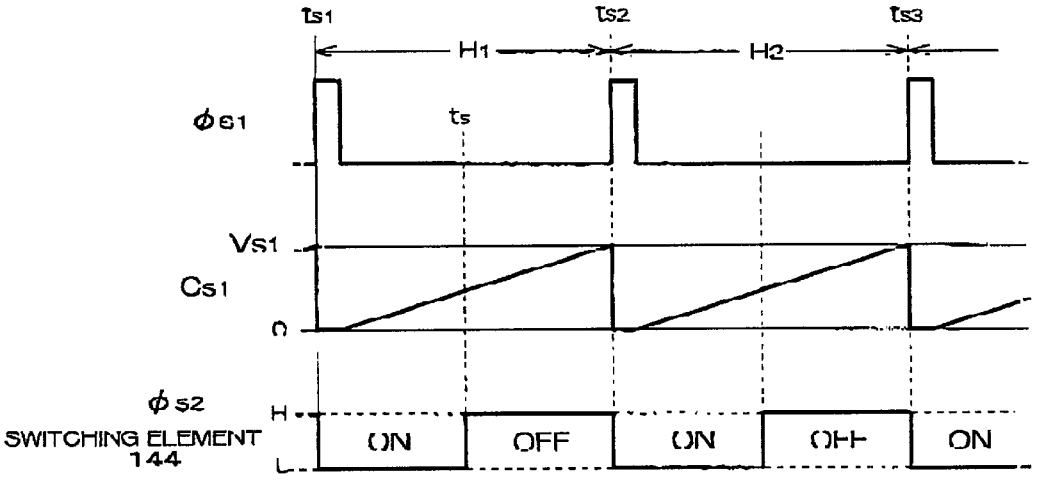
FIG. 3B is a timing chart for explaining the operation of the measuring circuit.

FIG. 3B illustrates a timing chart for the measuring circuit 150.

The signal $\phi_{S3}$ supplied based on the horizontal sync signal Hsync which corresponds to each selection period $H_n$ ($1 \leqq n \leqq 600$) closes the switching element 156, thus discharging charges stored in the capacitor 154. At the same time, the buffer circuit 158 outputs a signal $\phi_{S2}$ having an "L" level. Then, the switching element 156 is opened so that the capacitor 154 is gradually charged in proportional to the time by the constant current circuit 152 as indicated by a waveform $C_{S1}$. At a certain time $t_S$ during the charging, the buffer circuit 158 outputs a signal $\phi_{S2}$ having an "H" level.

In a period from $t_{S1\ to\ tS}$ in the selection period $H_1$ shown in FIG. 3B, therefore, the switching element 144 is turned on and the voltage supplied from the voltage generation circuit 130 in the voltage transformation circuit 24 is supplied to the adder 140 under the control of the measuring circuit 150. Then, a boosted data signal voltage $V_{add}$ is supplied to the data line X. In a period from $t_S$ to $t_{S2}$, on the other hand, the switching element 144 is turned off, inhibiting the supply of the voltage boosted by the voltage generation circuit 130 to the adder 140 and the original data signal voltage Vd is supplied to the data line X.

Figure 4:
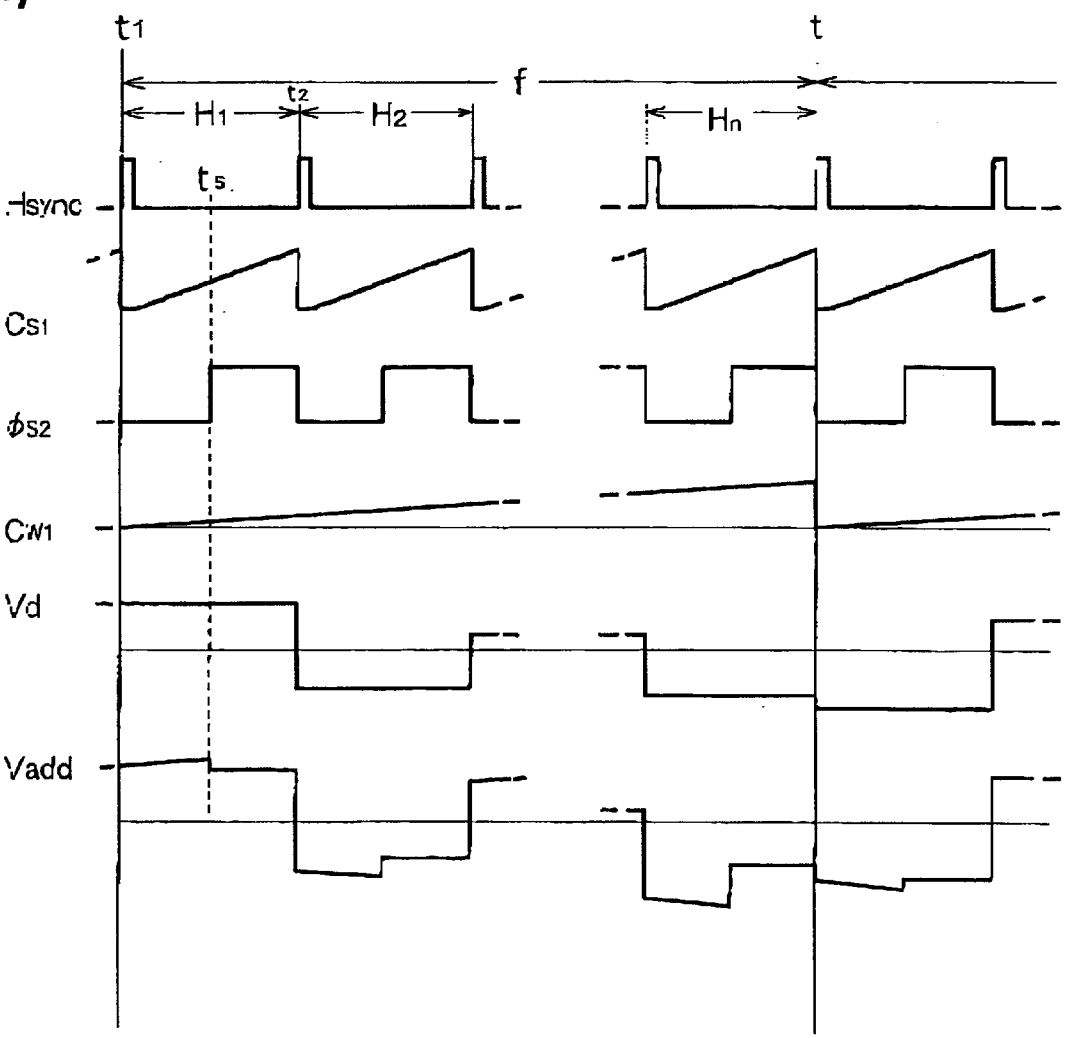
FIG. 4 is a diagram showing a timing chart for the liquid crystal device that uses the voltage transformation circuit shown in FIG. 2A.

FIG. 4 shows a timing chart when the data signal voltage $V_{add}$ acquired by boosting the original data signal voltage Vd is generated by the voltage transformation circuit 24 in the above-described manner. In the following description referring to FIGS. 4 to 6, the liquid crystal device is driven by a dot inversion system which inverts the phase dot by dot in driving the liquid crystal device.

Referring to FIG. 4, the boosted data signal voltage $V_{add}$ is produced by adding the voltage $C_{W1}$ of the capacitor 134 to the data signal voltage Vd in each of selection periods $H_1$ to $H_n$ at the timing at which the signal $\phi_{S2}$ having a voltage of an "H" level is output. This makes it possible to add a higher voltage to the data signal voltage Vd as the distance between the data-line drive circuit 22 which is a voltage supply source and each pixel selected becomes longer.

Figure 5:
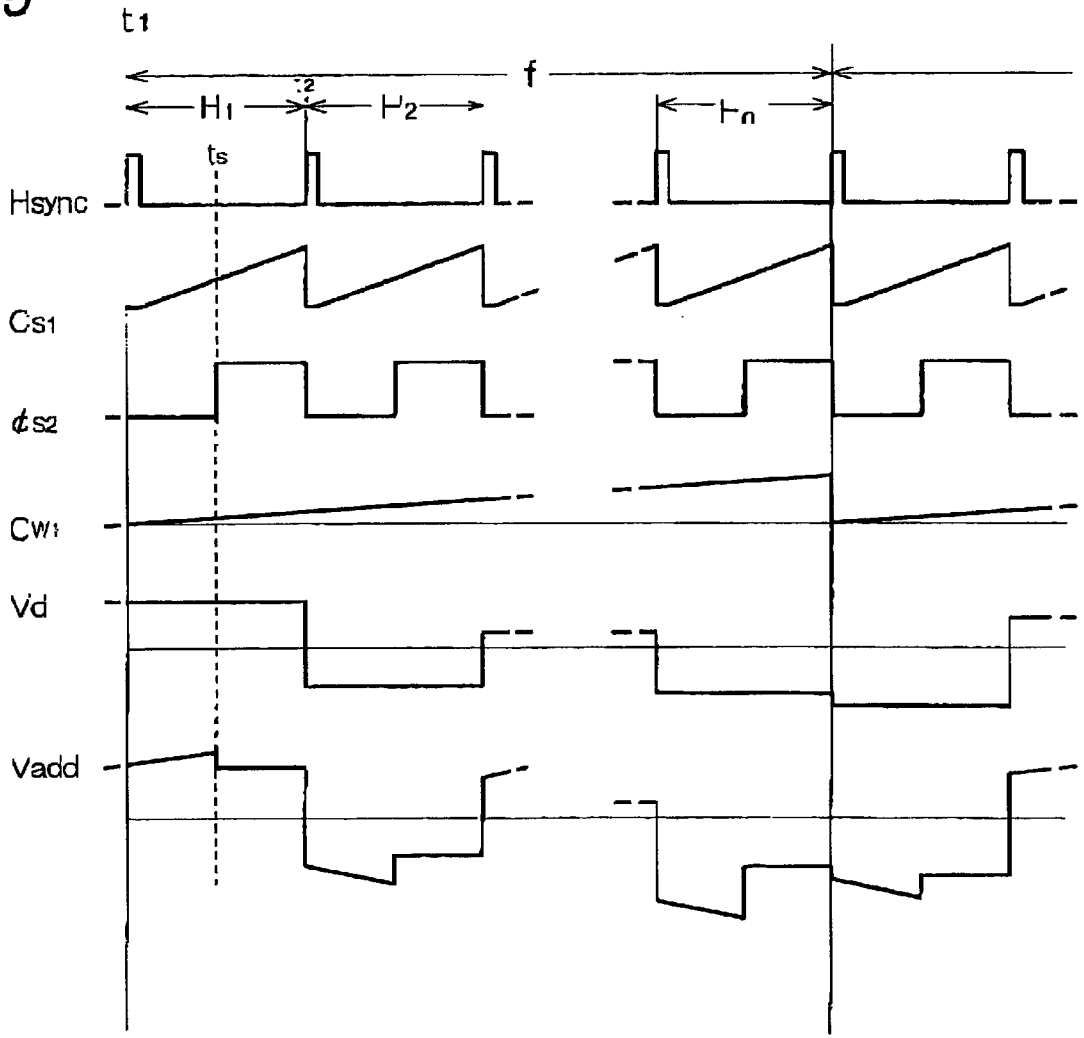
FIG. 5 is a diagram showing a timing chart for the liquid crystal device that uses another voltage transformation circuit.
Figure 6:
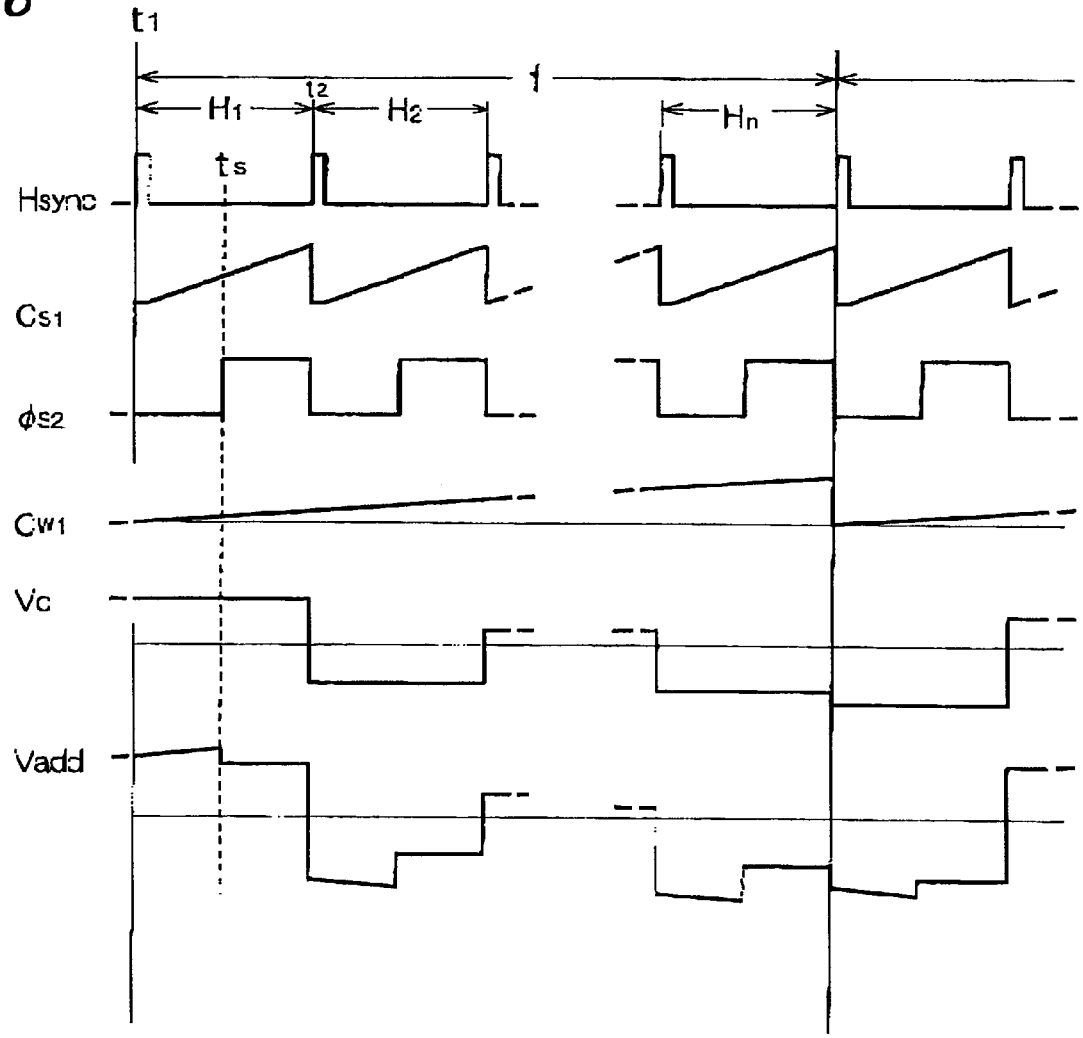
FIG. 6 is a diagram showing a timing chart for the liquid crystal device that uses a different voltage transformation circuit.

FIGS. 5 and 6 show timing charts, as modifications of the one shown in FIG. 4, when the level of the voltage $C_{W1}$ is converted with an arbitrary function by an adequate circuit provided and the voltage after the conversion or the voltage $C_{W1}$ is added to the original data signal voltage Vd.

Referring to FIG. 5, the boosted data signal voltage $V_{add}$ is produced by further adding a voltage equivalent to $C_{W1} \times C_{W1}$ which has been generated based on the level of the voltage $C_{W1}$ of the voltage 134 shown in FIG. 2 onto the data signal voltage Vd at a boosting timing similar to the one in FIG. 4, This makes it possible to add a higher voltage to the data signal voltage Vd in a boosting period in which the original data signal voltage Vd is boosted.

Referring to FIG. 6, the boosted data signal voltage $V_{add}$ is produced by adding a voltage, which is the voltage $C_{W1}$ of the voltage 134 shown in FIG. 2 associated with the original data signal voltage Vd, to the data signal voltage Vd. In this case, a voltage equivalent to $C_{W1} \times Vd$ is added to the data signal voltage Vd. This can ensure addition of the voltage that has been boosted in association with the original data signal voltage Vd to the data signal voltage Vd, not simple addition of a specific voltage of the same level to the original data signal voltage Vd.

Figure 7:
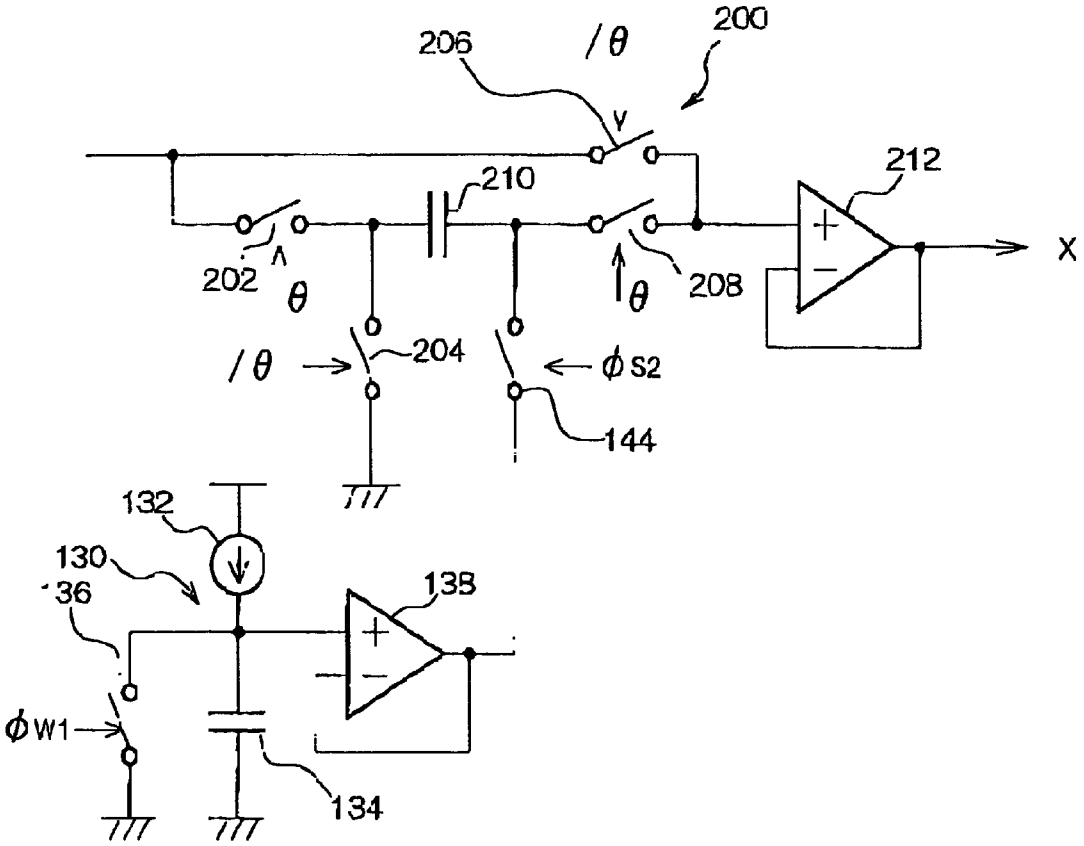
FIG. 7 shows a modification of the internal circuit of the voltage transformation circuit shown in FIG. 2A.
Figure 8:
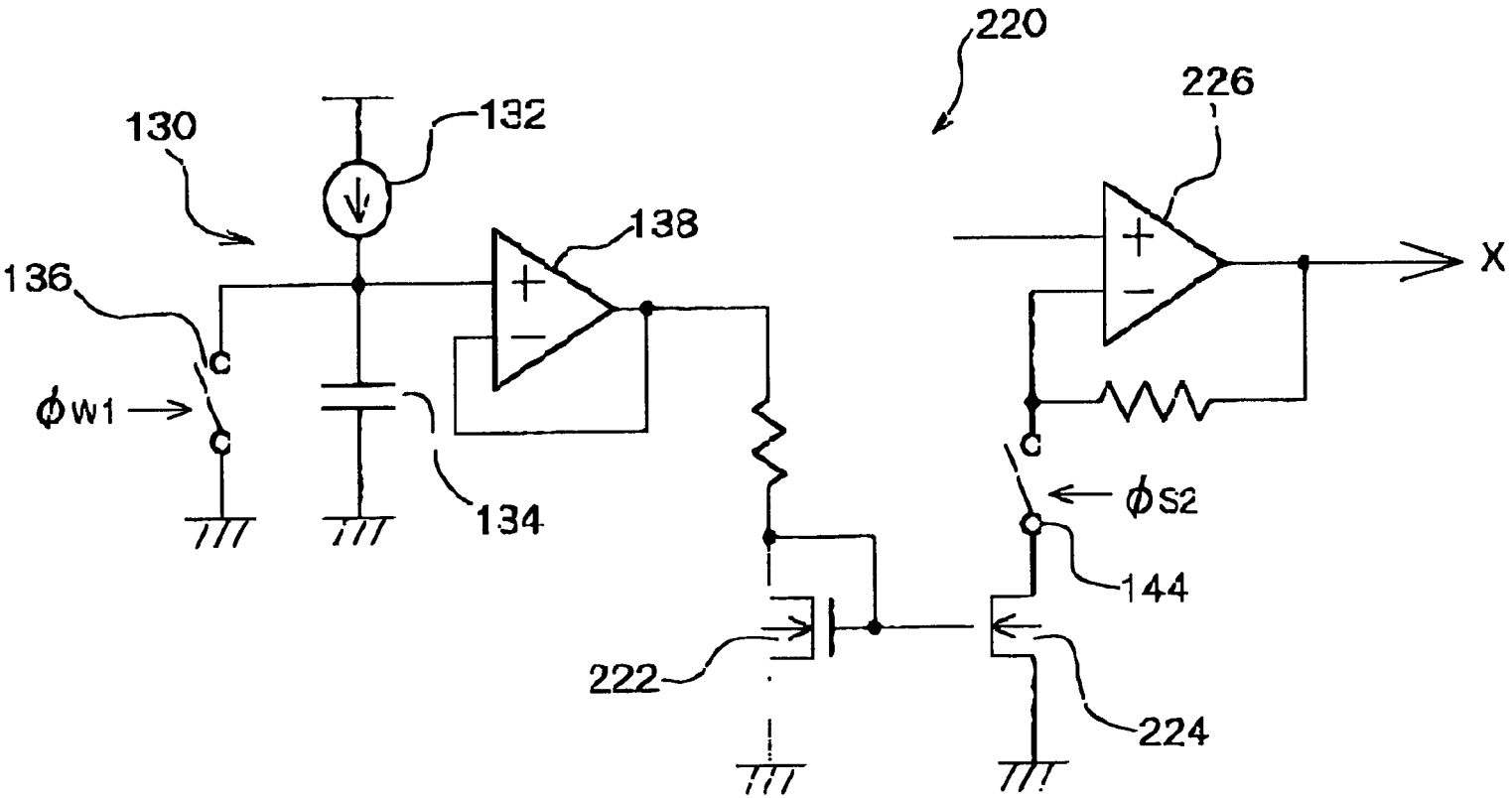
FIG. 8 shows another modification of the internal circuit of the voltage transformation circuit shown in FIG. 2A.

FIGS. 7 and 8 show modifications in which the voltage transformation circuit is provided in the data-line drive circuit 22.

A voltage transformation circuit 200 in FIG. 7 has switching elements 202 to 208 and a capacitor 210 provided on a supply line which supplies the data signal voltage Vd to the data line X. The ON/OFF actions of the switching elements 202 and 208 are controlled by a clock pulse θ, and the ON/OFF actions of the switching elements 204 and 206 are controlled by a clock pulse/θ. The clock pulse /θ shows the inverse logic of the logic of the clock pulse θ. The clock pulse θ is supplied based on the output signal $\phi_{S2}$. This structure can also add the voltage of the capacitor 210 charged by the voltage generation circuit 130 to the original data signal voltage Vd.

A voltage transformation circuit 220 in FIG. 8 is provided with a current mirror circuit constituted by switching elements 222 and 224. As the switching element 144 is turned on based on the output signal $\phi_{S2}$, the voltage generated by the voltage generation circuit 130 can be added to the original data signal voltage Vd.

The charge characteristics of the capacitors 134 and 154 can be varied by changing time constants ι of the voltage generation circuit 130 and the measuring circuit 150.

Figure 18A:
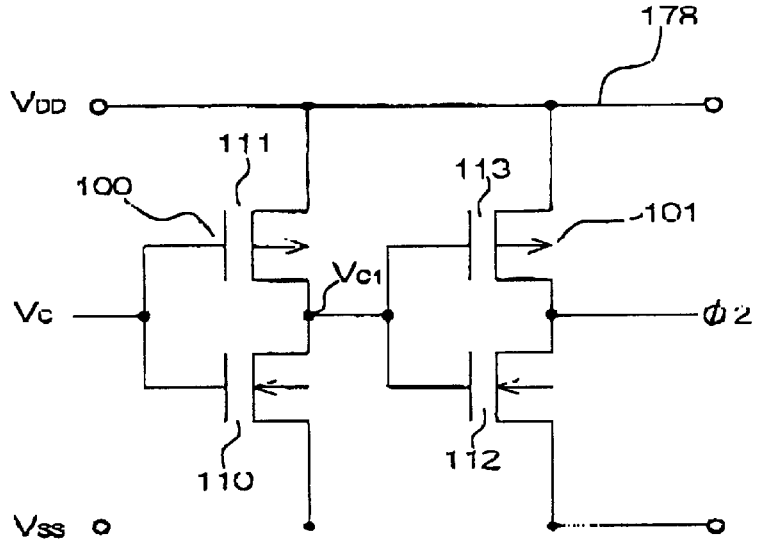
Figure 18B:
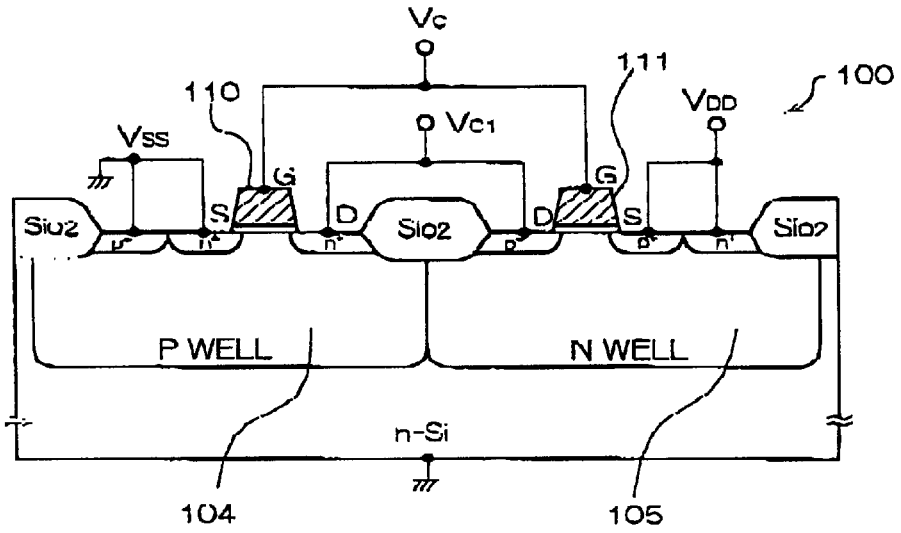

Alternatively, the timings of outputting signals of "H" and "L" levels can be changed by changing a threshold voltage $V_{th}$ of each of the switching elements that constitute the buffer circuit 158 of the measuring circuit 150 in FIG. 3. For example, the buffer circuit 158 has two inverter circuits 100 and 101 connected in series as shown in FIG. 18A. The inverter circuit 100 includes an N channel MOS (NMOS) transistor 110 and a PMOS channel transistor 111. The inverter circuit 101 includes an NMOS transistor 112 and a PMOS transistor 113. FIG. 18B is a cross-sectional view of the inverter circuit 100. To change the time needed for the buffer circuit 158 to be enabled, for example, the concentration of a p-type well 104 or the concentration of an n-type well 105 of the inverter circuit 100 is changed. As one example, the threshold voltage can be set low by increasing the concentration of an n-type diffusion layer 104 of one of the NMOS transistors 110 and 112 of the inverter circuits 100 and 101 or the concentrations of the n-type diffusion layers 104 of both NMOS transistors. As a result, the buffer circuit 158 can be enabled quickly. Therefore, the voltage transformation circuit 24 can shorten the period for boosting the original data signal voltage Vd.

The threshold voltage may be changed by changing the gate lengths and channel widths of the NMMOS transistor 110 and the PMOS transistor 111 of the inverter circuit 100 and/or the gate lengths and channel widths of the NMMOS transistor 112 and the PMOS transistor 113 of the inverter circuit 101.

The liquid crystal panel 10 can be adjusted to operate optimally by changing the time constant τ and the performance of each switching element itself.

In the embodiment, the voltage transformation circuit changes the data signal voltage Vd to be supplied to individual pixels corresponding to a line to be scanned in one frame period. At this time, a boosted, high voltage is supplied to the data line X in a given period within a selection period based on the distance between each selected pixel and the data-line drive circuit. This can overcome the problem such that pixels cannot be charged sufficiently within a selection period due to the parasitic resistance and parasitic capacity.

Second Embodiment

Figure 9:
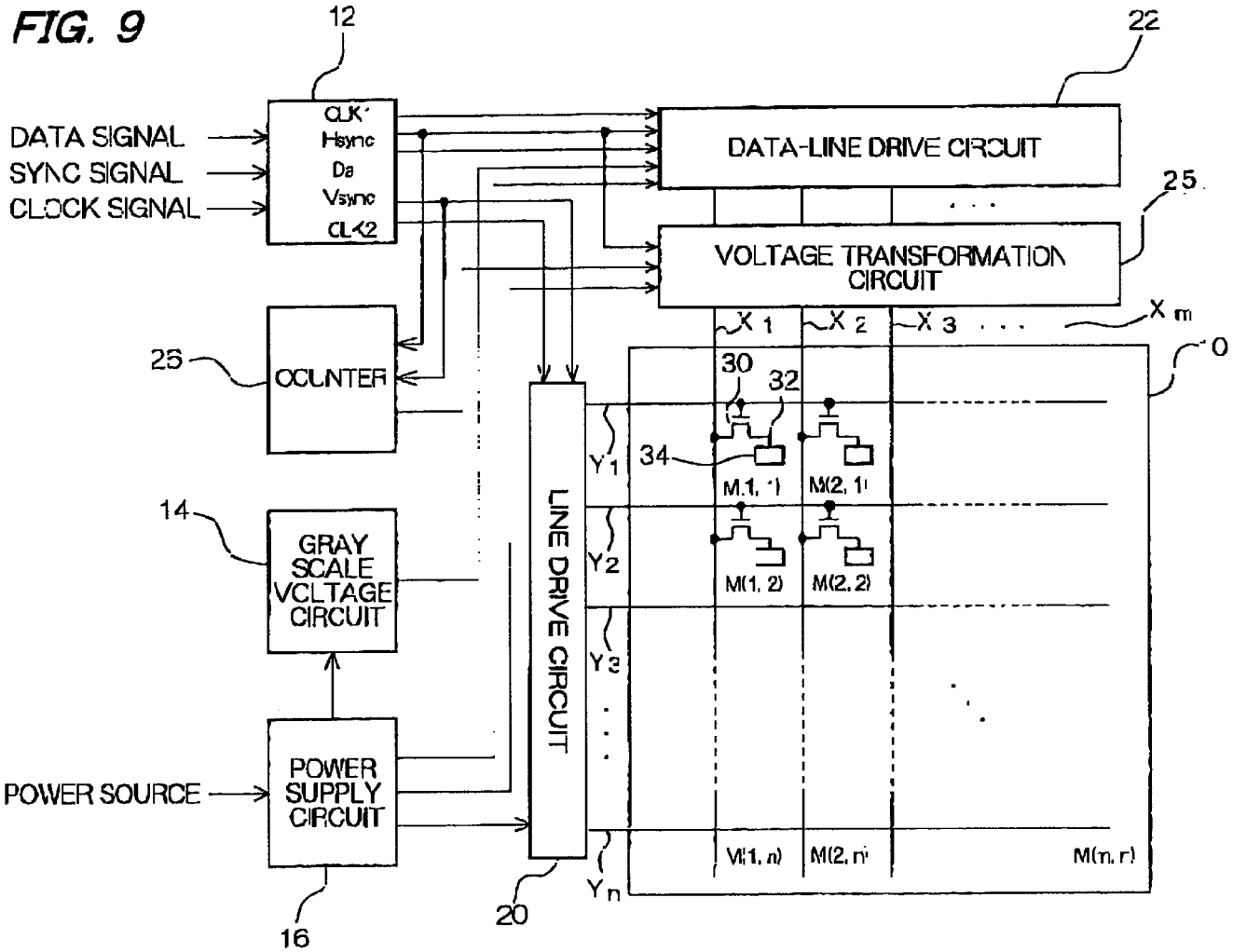
FIG. 9 is a diagram illustrating a liquid crystal device according to a second embodiment of the invention.

FIG. 9 presents a block diagram of a TFT type liquid crystal device according to the second embodiment of the invention.

The liquid crystal device includes a liquid crystal panel 10, a signal control circuit section 12, a gray scale voltage circuit section 14, a power supply circuit section 16, a line drive circuit 20, a data-line drive circuit 22, a voltage transformation circuit 25 and a counter 26.

The signal control section 12 sends the horizontal sync signal Hsync and the vertical sync signal Vsync to the counter 26. The counter 26 has a capability of counting the number of the horizontal sync signals Hsync or the number of lines Y scanned in one frame period.

For example, the voltage transformation circuit 25 includes a booster circuit (not shown) which determines the level of a boosted voltage based on the count value of the counter 26 and an adder (not shown) which adds the voltage from the booster circuit to the original data signal voltage Vd.

The operation of the liquid crystal device in FIG. 9 will be discussed with reference to timing charts illustrated in FIGS. 10A through 10C. The liquid crystal panel 10 in FIG. 9 has a resolution of, for example, (800×600) pixels. That is, the liquid crystal panel 10 has pixels M(1, 1) to M(800, 600).

For the sake of convenience, the following description with reference to FIGS. 10A to 10C will be given of the liquid crystal panel 10 as separated into three areas of pixels M(1, 1) to (M(1, 199), pixels M(1, 200) to (M(1, 399) and pixels M(1, 400) to (M(1, 600). FIGS. 10A to 10C respectively show charge characteristics of the three pixels M(1, 1), M(1, 200) and M(1, 400) in the respective three areas. In this case, a predetermined voltage $V_1$ is applied to each of the three pixels M(1, 1), M(1, 200) and M(1, 400) by the data-line drive circuit 22.

Figures 10A, 10B, 10C:
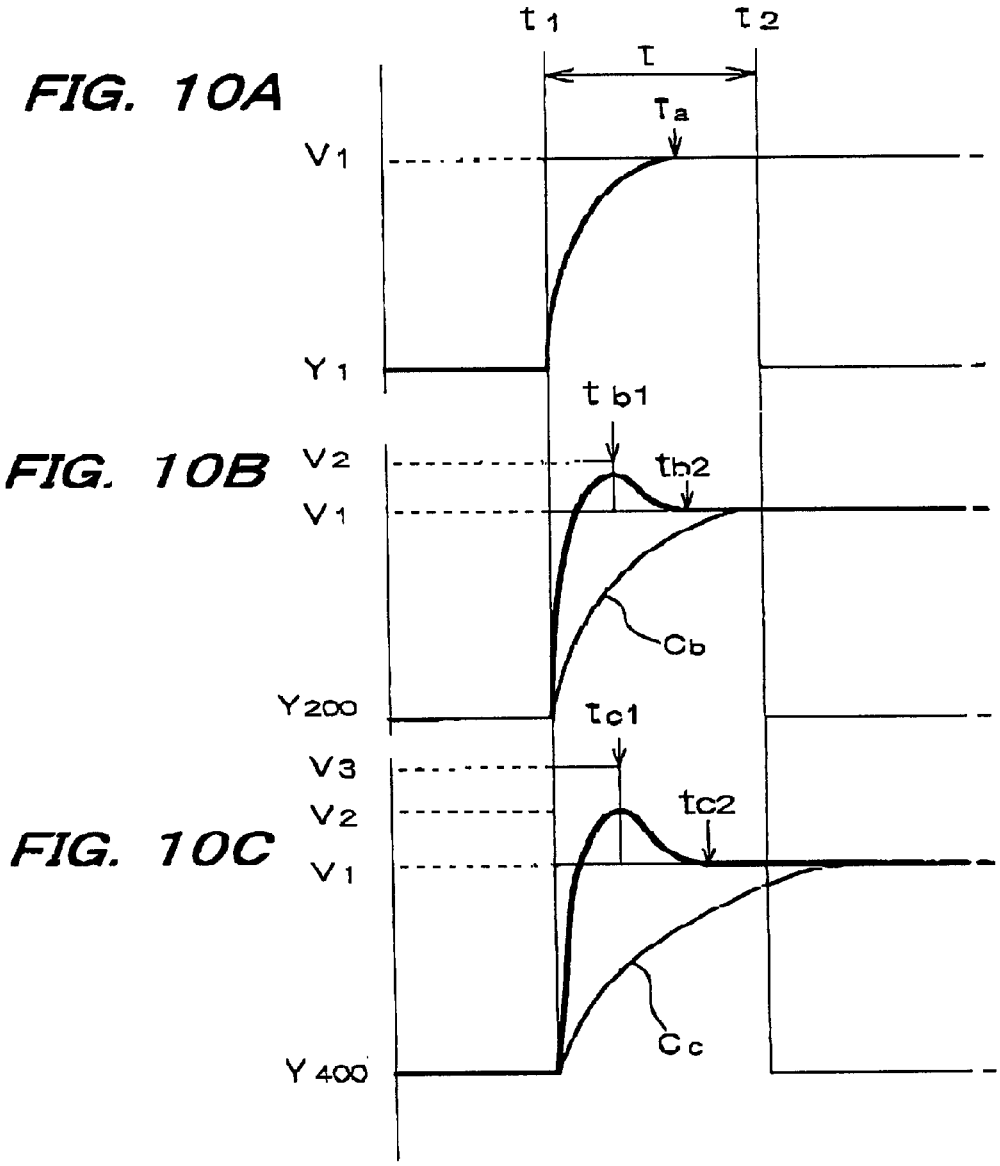
FIGS. 10A through 10C are diagrams respectively showing charge characteristics of pixels M(1, 1), M(1, 200) and M(1, 400) of the liquid crystal device shown in FIG. 9.

FIG. 10A shows a line $Y_1$ selected and how the pixel M(1, 1) associated with the line $Y_1$ is charged. The pixel M(1, 1) is charged to the predetermined voltage $V_1$ at time $t_A$ in a selection period t over which the line $Y_1$ is selected.

Figure 21A:
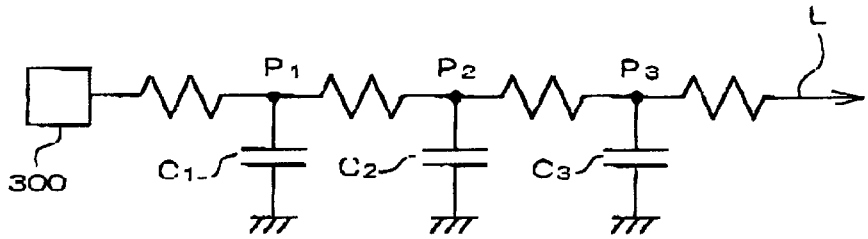
FIG. 21A is a circuit diagram of a T type or $\pi$ type model and FIG. 21B is a diagram showing charge characteristics of capacitors $C_1$, $C_2$ and $C_3$.
Figure 21B:
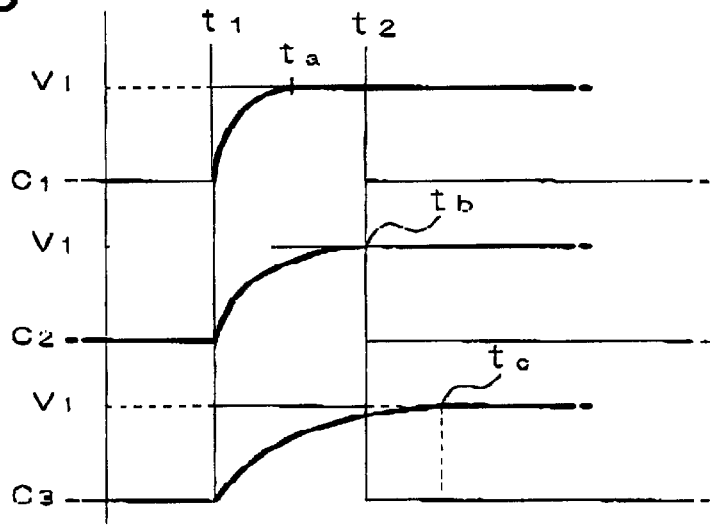

FIG. 10B shows how the pixel M(1, 200) associated with a line $Y_{200}$ selected is charged. As mentioned in the foregoing description referring to FIGS. 21A and 21B, as the distance from the data-line drive circuit 22 to each pixel to be charged becomes longer, the charge characteristic of the pixel has a gentle slope. A curve $C_b$ shown in FIG. 10B shows the pixel M(1, 200) charged with the data signal voltage $V_1$ supplied from the data-line drive circuit 22. In this case, the voltage of the pixel M(1, 200) does not reach the predetermined voltage $V_1$ until time $t_2$ which is close to the end of the selection period t. As the distance from the data-line drive circuit 22 to the pixel M(1, 400) becomes longer, however, the charge characteristic of the pixel M(1, 400) shows a gentler slope as indicated by a curve $C_c$ shown in FIG. 10C. Therefore, the voltage of the pixel M(1, 400) cannot reach the predetermined voltage $V_1$ within the selection period t. To improve such a charge characteristic, a voltage higher than the predetermined voltage is applied for a given period within the selection period t to promptly charge the pixel.

When the pixel M(1, 200) is selected as in FIG. 10B, the count value of the counter 26 should indicate "200". At this time, the voltage transformation circuit 25 boosts the data signal voltage $V_1$ to be supplied from the data-line drive circuit 22 based on the count value of 200. A data signal voltage $V_2$ after boosting is supplied to the pixel M(1, 200) in a period from $t_1$ to $t_{b1}$. At and after $t_{b1}$, the voltage that is supplied to the pixel M(1, 200) is switched to the original data signal voltage $V_1$ and becomes stable at the predetermined voltage $V_1$ at time $t_{b2}$.

In FIG. 10C, likewise, a data signal voltage $V_3$ after boosting by the voltage transformation circuit 25 is supplied to the pixel M(1, 400) in a period from $t_1$ to $t_{c1}$. At and after $L_{c1}$, the voltage that is supplied to the pixel M(1, 400) is switched to the original data signal voltage $V_1$ and becomes stable at the predetermined voltage $V_1$ at time $t_{c2}$.

The boosted voltage $V_2$ is so set as to be higher than the predetermined voltage $V_1$ and to be able to stabilize the voltage at $V_1$ in the selection period t when it is switched to the voltage $V_1$ at time $t_{b1}$. Likewise, the boosted voltage $V_3$ is so set as to be higher than the voltage $V_2$ and to be able to stabilize the voltage at $V_1$ in the selection period t when it is switched to the voltage $V_1$ at time $t_{c1}$. To permit the voltage to become stable at the predetermined voltage $V_1$ in the selection period t, both times $t_{b1}$ and $t_{c1}$ should be set close to time $t_1$.

Figure 11A:
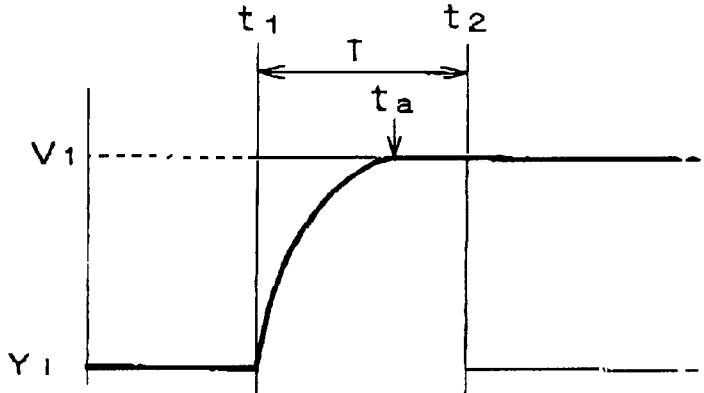
FIGS. 11A through 11C are diagrams also respectively showing charge characteristics of the pixels M(1, 1), M(1, 300) and M(1, 600) of the liquid crystal device shown in FIG. 9.
Figure 11B:
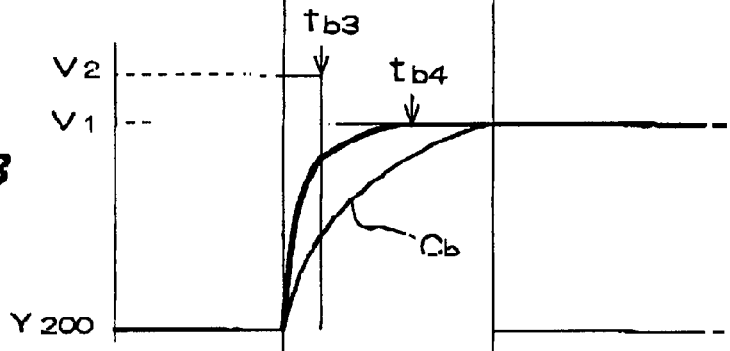
Figure 11C:
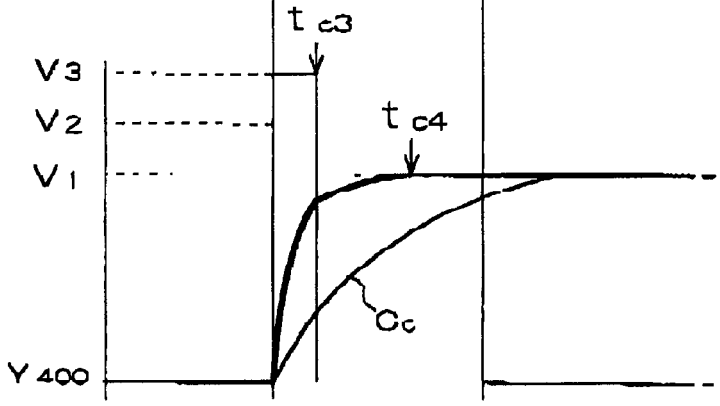

FIGS. 11A through 11C illustrate a modification of the embodiment. FIGS. 11A to 11C show charge characteristics when the periods of boosting the data signal voltage $V_1$ which are set in FIGS. 10A to 10C are changed. The data-line drive circuit 22 supplies the data signal voltage $V_1$ to each of the three areas of the pixels M(1, 1) to M(1, 199), M(1, 200) to M(1, 399) and M(1, 400) to M (1, 600).

In FIG. 11B, the data signal voltage Vd is boosted in a period from $t_1$ to $t_{b3}$. The period from $t_1$ to $t_{b3}$ is set shorter than the corresponding period from $t_1$ to $t_{b1}$ in FIG. 10B. Accordingly, the voltage reaches the predetermined voltage $V_1$ at time $t_{b4}$. In FIG. 11C, likewise, a period from $t_1$ to $t_{c3}$ is set shorter than the corresponding period from $t_1$ to $t_{c1}$ in FIG. 10C. Accordingly, the voltage reaches the predetermined voltage $V_1$ at time $t_{c4}$.

As illustrated in FIGS. 10A to 10C and FIGS. 11A to 11C, it is possible to execute such control as to charge each pixel selected in the predetermined period t by boosting the predetermined voltage $V_1$ to a certain voltage level and changing the period in which the boosted voltage is applied.

In the embodiment, the liquid crystal panel 10 is separated into three areas as one example, and the data signal voltage $V_{add}$ boosted by the voltage transformation circuit 25 is supplied to the individual pixels in each area. The invention is not particularly limited to the case of separating the liquid crystal panel 10 to three areas, but the liquid crystal panel 10 may be separated into a greater number of areas to which different boosted data signal voltages Vd are supplied. More specifically, in FIG. 9, the voltage transformation circuit 25 may sequentially boosts the data signal voltages Vd to be supplied to the individual pixels every time the horizontal sync signal Hsync is supplied to the counter 26 or a single line is selected.

Further, as mentioned earlier, the charge characteristic can be varied by changing the time constant $\tau$ of each component provided in the voltage transformation circuit 25 and the performance of each switching element itself. This can ensure adequate alteration of the period over which the boosted data signal voltage $V_{add}$ is supplied to the data line X.

According to the embodiment, the data signal voltage to be supplied to the individual pixels corresponding to the line that is to be scanned is changed by the voltage transformation circuit. Based on the distance between the selected pixel and the data-line drive circuit, a boosted, high voltage is supplied to the data line X in a given period within the selection period. This can overcome the problem such that pixels cannot be charged sufficiently within the selection period due to the parasitic resistance and parasitic capacity.

Third Embodiment

Figure 12:
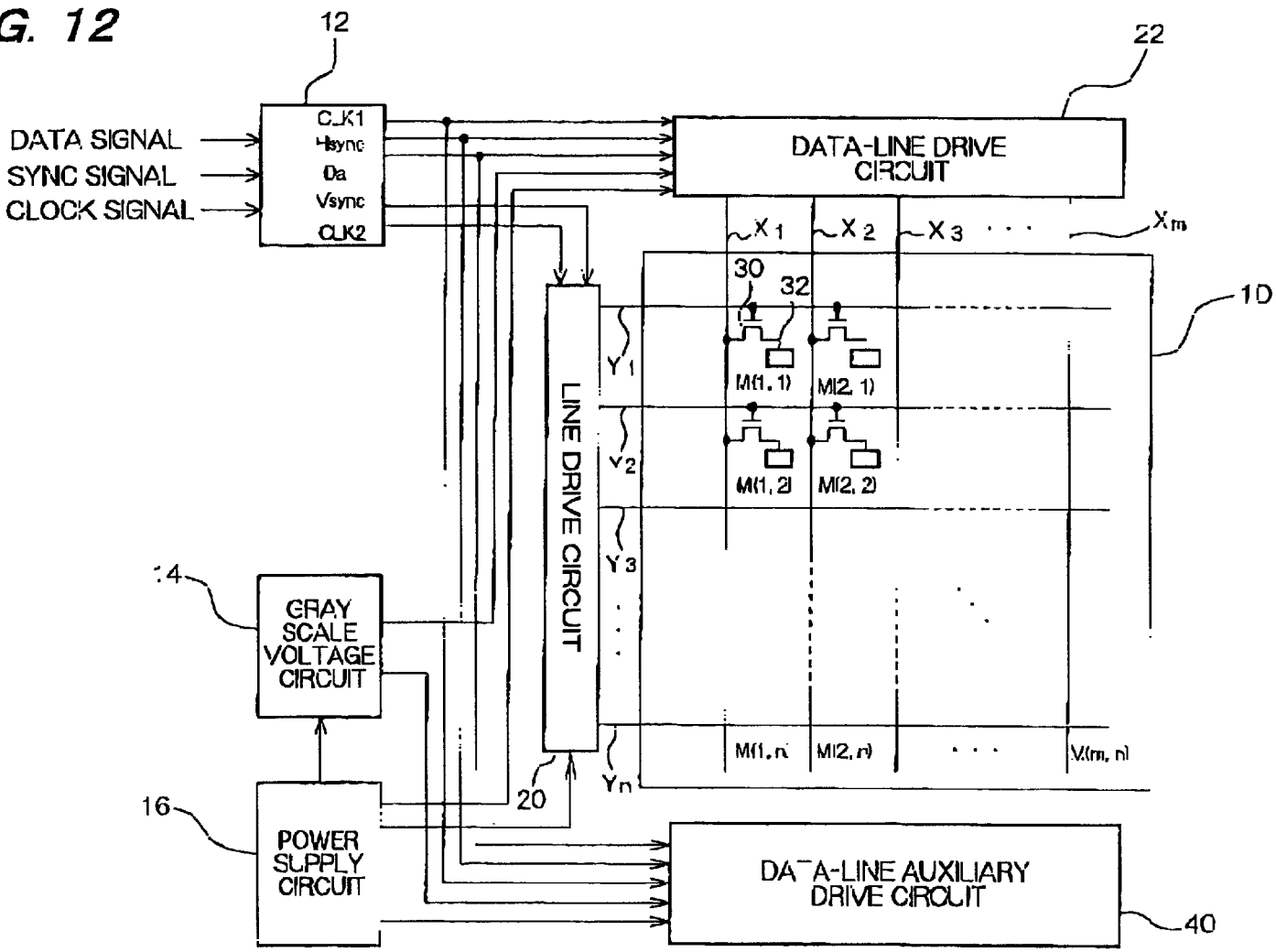
FIG. 12 is a diagram illustrating a liquid crystal device according to a third embodiment of the invention.

A liquid crystal device shown in FIG. 12 includes a liquid crystal panel 10, a signal control circuit section 12, a gray scale voltage circuit section 14, a power supply circuit section 16, a line drive circuit 20, a data-line drive circuit 22 and a data-line auxiliary drive circuit 40. In this example, RGB data signals Da each consisting of 8 bits are supplied to the data-line drive circuit 22.

The liquid crystal device in FIG. 12 is externally supplied with power, data signals and sync signals.

The operations of devices other than data-line auxiliary drive circuit in FIG. 12 are similar to those described for FIG. 1.

The signal control circuit section 12 sends the clock signal CLK1, data signals Da and a horizontal sync signal Hsync to the data-line auxiliary drive circuit 40. RGB data signals Da each consisting of 8 bits, or RGB data signals Da' of a lower gray scale quantity than that of the 8-bit RGB data signals Da are supplied to the data-line auxiliary drive circuit 40. In the embodiment, RGB data signals Da each consisting of 8 bits are supplied to the data-line auxiliary drive circuit 40 as RGB data signals Da.

The data-line auxiliary drive circuit 40 lathes the RGB data signals Da each consisting of 8 bits at the timing of the clock signal CLK1. In synchronism with the latching of one line of RGB data signals Da, the horizontal sync signal Hsync is sent to the data-line auxiliary drive circuit 40. Based on the horizontal sync signal Hsync, the latched one line of RGB data signals Da is converted to analog signals which are then subjected to impedance conversion. The resultant signals are supplied to the data line X.

To execute gray scale display, the gray scale voltage circuit section 14 supplies the data-line drive circuit 22 and the data-line auxiliary drive circuit 40 with reference voltages that are set in the same voltage range.

The liquid crystal device in FIG. 12 is provided with two drive circuits, namely, the data-line drive circuit 22 and the data-line auxiliary drive circuit 40, at positions facing each other with respect to the liquid crystal panel 10. In the related art, the liquid crystal panel 10 is driven by the data-line drive circuit 22 alone. In the liquid crystal device of the embodiment shown in FIG. 12, however, the data-line auxiliary drive circuit 40 supplies the data signal voltage Vd to each data line X from the direction of a line $Y_{600}$ which is located farthest from the data-line drive circuit 22 which is a voltage supply source. That is, the data-line drive circuit 22 supplies the data signal voltage Vd to each data line X from one end thereof, and the data-line auxiliary drive circuit 40 sends the data signal voltage Vd to the data line X from the other end thereof.

Figure 13A:
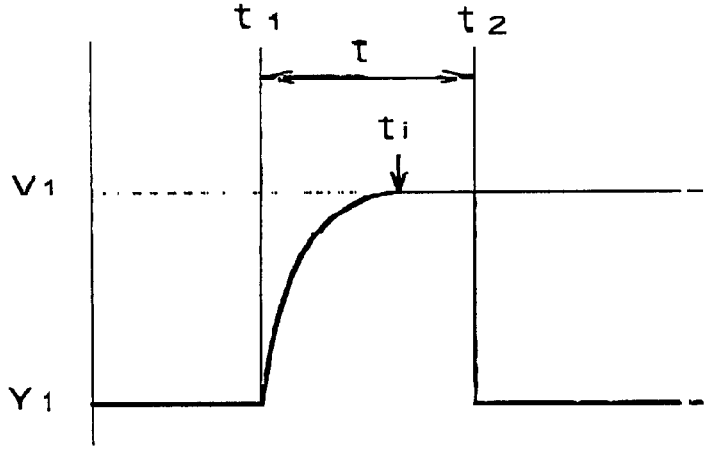
FIGS. 13A through 13C are diagrams respectively showing charge characteristics of pixels M(1, 1), M(1, 300) and M(1, 600) of the liquid crystal device shown in FIG. 12.
Figure 13B:
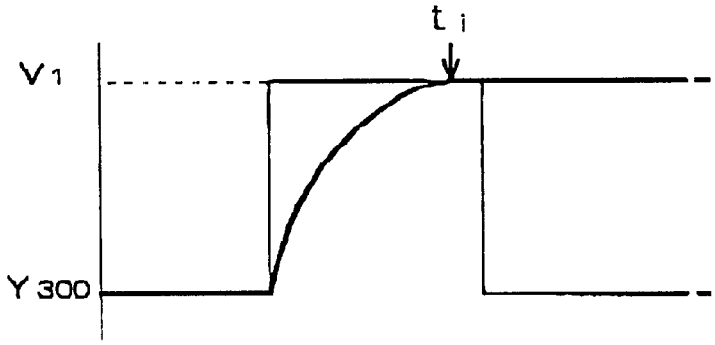
Figure 13C:
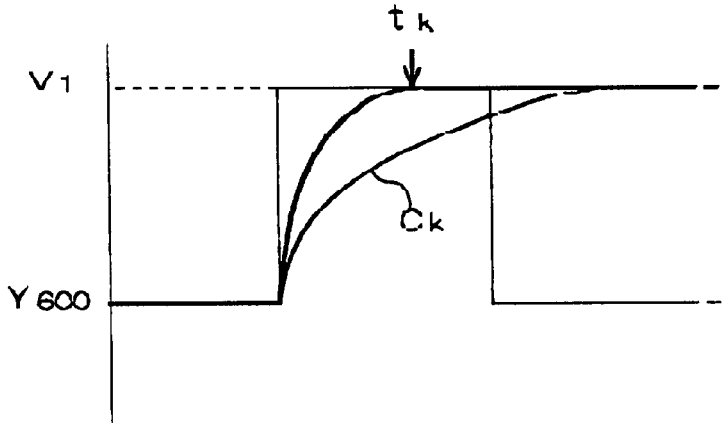

The operation of the liquid crystal device in FIG. 12 will be discussed with reference to timing charts in FIGS. 13A to 13C. The data-line auxiliary drive circuit 40 is used together with the data-line drive circuit 22. For the sake of convenience, the following description will be given of the liquid crystal panel 10 as separated into two areas of pixels M(1, 1) to (M(1, 299) and pixels M(1, 300) to (M(1, 600). FIGS. 13A to 13C respectively show charge characteristics of the three pixels M(1, 1), M(1, 300) and M(1, 600). A curve $C_k$ shows the charge characteristic according to the driving system in the related art for the purpose of comparison.

Referring to FIG. 13A, as the distance between the data-line drive circuit 22 which is a voltage supply source and the selected pixel M(1, 1) is short, the pixel M(1, 1) is charged rapidly and its voltage reaches the predetermined voltage $V_1$ at time $t_i$ in the selection period t.

Referring to FIG. 13B, the distance between the data-line drive circuit 22 which is a voltage supply source and the selected pixel M(1, 300) is approximately equal to the distance between the data-line auxiliary drive circuit 40 and the selected pixel M(1, 300). Therefore, the illustrated charge characteristic shows a slightly gentler slope and the voltage of the pixel M(1, 300) reaches the predetermined voltage $V_1$ at time $t_j$ in the selection period t.

Referring to FIG. 13C, as the distance between the data-line auxiliary drive circuit 40 and the selected pixel M(1, 600) is short, the selected pixel M(1, 600) is charged rapidly and its voltage reaches the predetermined voltage $V_1$ at time $t_k$ in the selection period t. The charge characteristics of the individual pixels become approximately symmetrical with the line $Y_{300}$ as a reference in the embodiment.

Figure 14A:
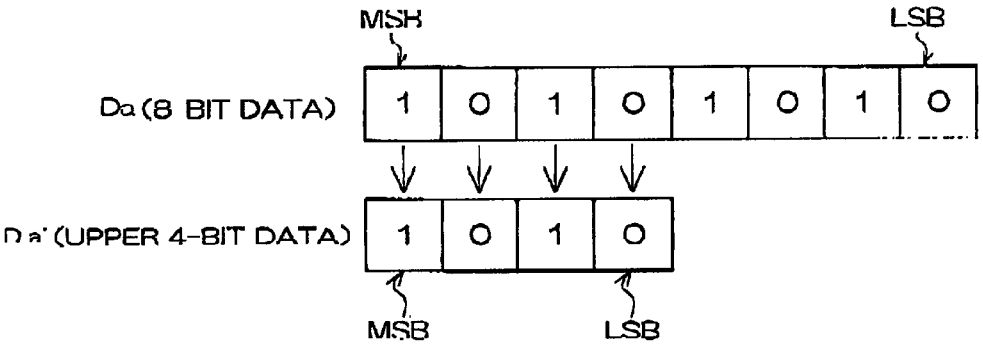
FIG. 14A is a diagram for explaining a data signal to be supplied to a data-line auxiliary drive circuit according to third and fourth embodiments of the invention.
Figure 14B:
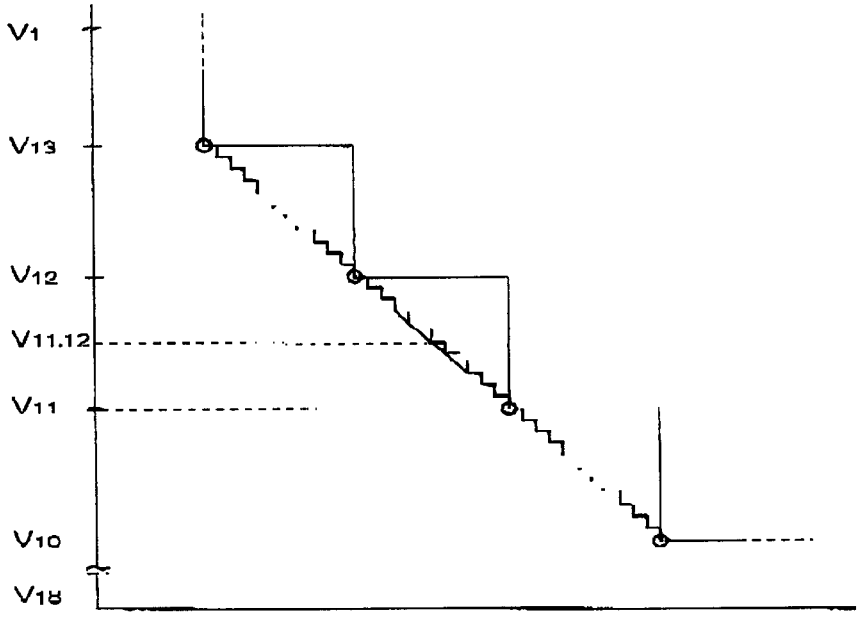
FIG. 14B is a diagram showing voltages to be supplied to a data line X from a data-line drive circuit and the data-line auxiliary drive circuit according to the third and fourth embodiments of the invention.

Although the data-line drive circuit 22 and the data-line auxiliary drive circuit 40 achieve the same accuracy of gray scale display in the embodiment, the data-line auxiliary drive circuit 40 may execute the gray scale display of lower accuracy than the data-line drive circuit 22 as mentioned earlier. As shown in FIG. 14A, for example, the data-line auxiliary drive circuit 40 may be supplied with a data signal Da' (1010) of upper four bits of the 8-bit data signal Da (10101010), which is supplied to the data-line drive circuit 22. It is to be noted however that the amplitudes of the voltages supplied to the data line X from the data line drive circuit 22 and the data-line auxiliary drive circuit 40 are set to the same range. As shown in FIG. 14B, a data signal voltage $V_{11,\ 12}$ is supplied to the data line X from the data-line drive circuit 22, while a data signal voltage $V_{11}$ is supplied to the data line X from the data-line auxiliary drive circuit 40. Even in the case where the data-line auxiliary drive circuit 40 supplies a rough data signal voltage to the data line X, the charge characteristic can be improved in nearly the same manner as the charge characteristic shown in FIG. 13C is improved.

The use of the two data-line drive circuits provided to face each other with respect to the liquid crystal panel can overcome the problem such that pixels cannot be charged sufficiently within the selection period due to the parasitic resistance and parasitic capacity.

Fourth Embodiment

Figure 15:
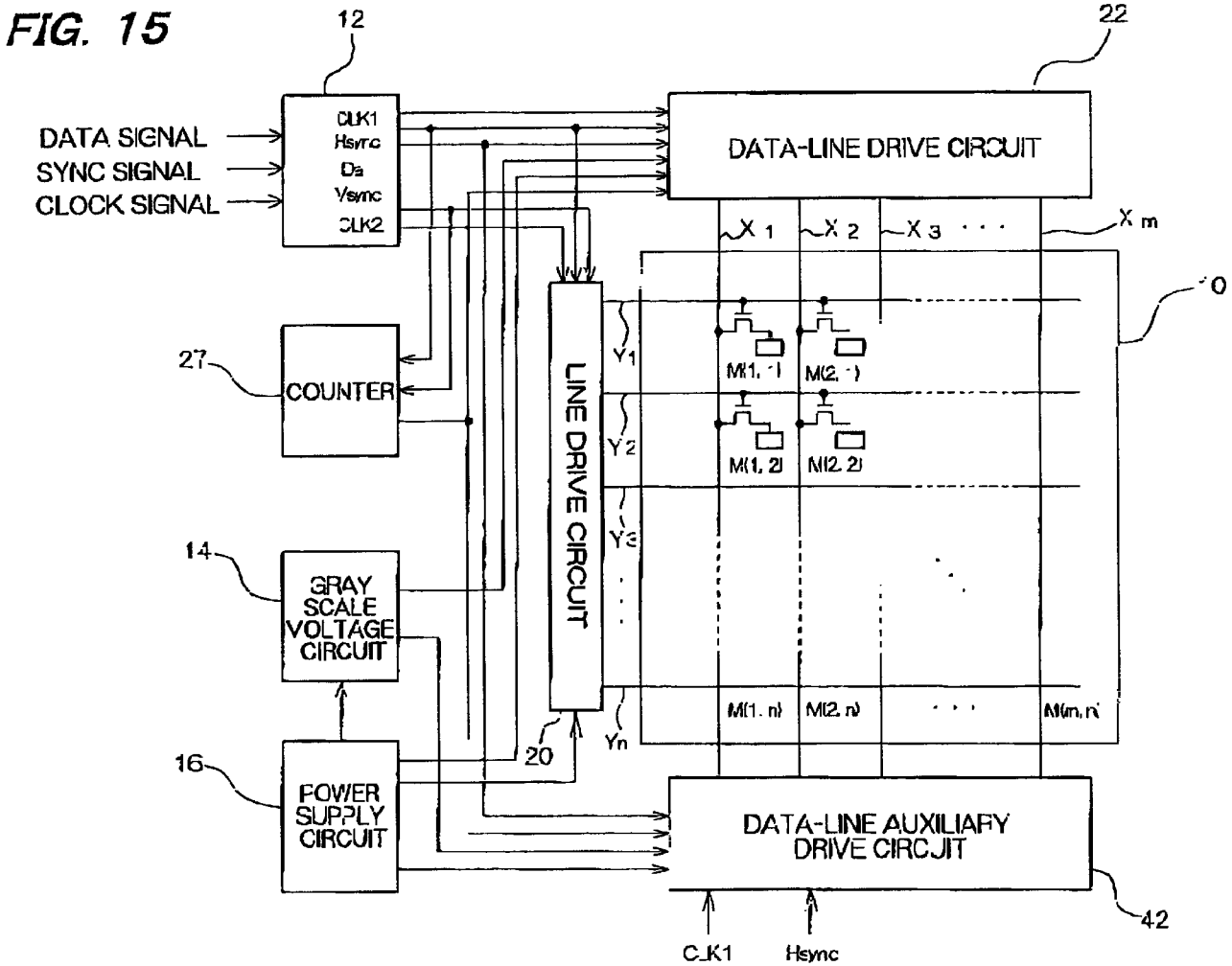
FIG. 15 is a diagram illustrating a liquid crystal device according to the fourth embodiment.

A liquid crystal device shown in FIG. 15 is the liquid crystal device shown in FIG. 12 which is additionally provided with a counter 27. Further, a data-line auxiliary drive circuit 42 is provided in place of the data-line auxiliary drive circuit 40 in FIG. 12. In addition, the driving of the data-line auxiliary drive circuit 42 is controlled based on a count value supplied from the counter 27.

The horizontal sync signal Hsync and vertical sync signal Vsync are supplied to the counter 27. Based on the horizontal sync signal Hsync, the counter 27 counts the number of lines Y scanned in one frame period and sends the count value to the data-line drive circuit 22 and the data-line auxiliary drive circuit 40. When one frame period ends, the counter 27 is reset by the vertical sync signal Vsync.

The data-line drive circuit 22 is supplied with RGB data signals Da each consisting of, for example 8 bits. The data-line auxiliary drive circuit 42 is supplied with RGB data signals Da' of a lower gray level than the 8 bit RGB data signals Da. In the embodiment, rough RGB data signals Da' each consisting of upper 4 bits are supplied to the data-line auxiliary drive circuit 42.

The liquid crystal device in FIG. 15, like the liquid crystal device in FIG. 12, is provided with two drive circuits, namely, the data-line drive circuit 22 and the data-line auxiliary drive circuit 42, at positions facing each other with respect to the liquid crystal panel 10. The data-line drive circuit 22 supplies the data signal voltage to each data line X from one end thereof, and the data-line auxiliary drive circuit 42 sends the data signal voltage to the data likes X from the other end thereof.

In the embodiment, the driving of the data-line auxiliary drive circuit 42 which is a voltage supply source is controlled in accordance with the distance between the data-line drive circuit 22 and the selected pixel.

The operation of the liquid crystal device in FIG. 15 will be discussed with reference to timing charts in FIGS. 16A and 16B. For the sake of convenience, the following description will be given of the liquid crystal panel 10 as separated into two areas of pixels M(1, 1) to M(1, 299) and pixels M(1, 300) to (M(1, 600). A curve $C_h$ shows the charge characteristic according to the driving system in the related art for the purpose of comparison.

Figure 16A:
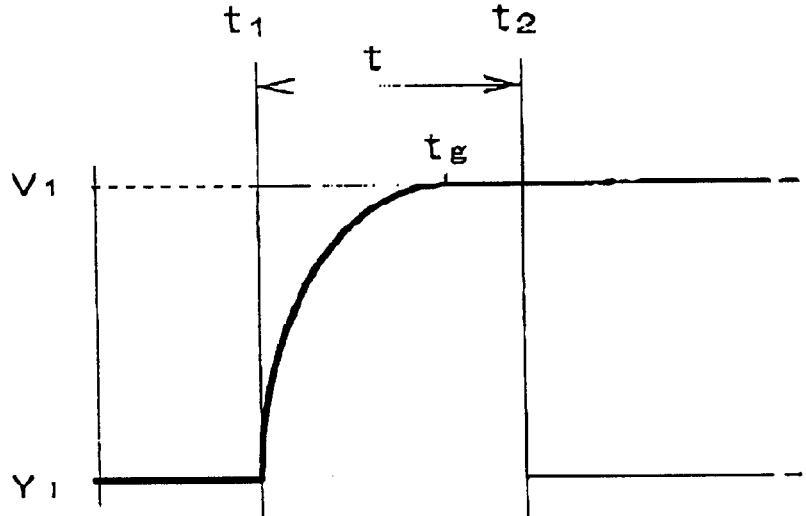
FIGS. 16A and 16B are diagrams respectively showing charge characteristics of pixels M(1, 1) and M(1, 400) of the liquid crystal device shown in FIG. 15.

Referring to FIG. 16A, as the first horizontal sync signal Hsync is input to the counter 27, the count value becomes "1". Based on the count value, it is determined whether the data-line drive circuit 22 in FIG. 15 alone is driven or both the data-line drive circuit 22 and the data-line auxiliary drive circuit 42 are driven. In the embodiment, only the data-line drive circuit 22 is driven when the count value is in a range of 1 to 299, and the data-line auxiliary drive circuit 42 is additionally driven for a given period in one frame period when the count value is in a range of 300 to 600. In FIG. 16A, therefore, the data-line drive circuit 22 alone is driven and the voltage is stable at the predetermined voltage $V_1$ at time $t_g$ in the selection period t.

Figure 16B:
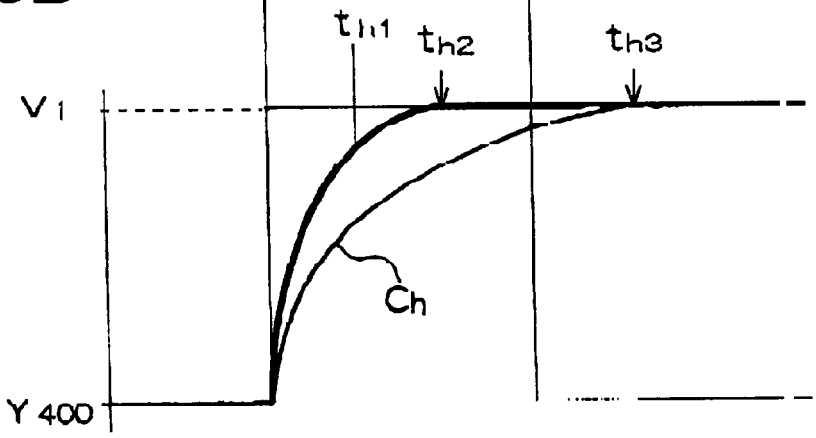

In FIG. 16B, the count value of the counter 27 is "400". Therefore, the data-line drive circuit 22 and the data-line auxiliary drive circuit 42 are driven simultaneously. The data-line auxiliary drive circuit 42 supplies each RGB data signal Da' of upper four bits in information of each 8-bit RGB data signal Da that is supplied to the data-line drive circuit 22. The supply of the RGB data signals Da' will be discussed again with reference to FIGS. 14A and 14B. As shown in FIG. 14A, for example, of the 8-bit signal data Da (10101010), signal data Da' (1010) of upper four bits is supplied to each data line X. The range of the reference voltage that is supplied to the data-line drive circuit 22 from the gray scale voltage circuit section 14 is the same as that of the reference voltage supplied to the data-line auxiliary drive circuit 42 from the gray scale voltage circuit section 14. As shown in FIG. 14B, therefore, the data-line auxiliary drive circuit 42 supplies the data line $X_1$ with the data signal voltage $V_{11}$ corresponding to the signal data Da' (1010). The 16 gray-scale data signal voltage $V_{11}$ is rougher and lightly lower than the voltage $V_{11,12}$ that should originally be supplied to the pixel M(1, 400). As the distance between the data-line auxiliary drive circuit 42 which is a voltage supply source and the pixel M(1, 600) is short, however, the pixel M(1, 400) can be charged quickly as compared with the case where the pixel is driven by the data-line drive circuit 22 alone. In the embodiment shown in FIG. 13B, the additional use of the data-line auxiliary drive circuit 42 until a period from $t_1$ to $t_{h1}$ can allow the pixel M(1, 400) to be charged to the predetermined voltage $V_1$ at time $t_{h2}$ in the selection period t.

According to the embodiment, as one example, the liquid crystal panel 10 is divided into two areas around the timing at which the line $Y_{300}$ is scanned and one area is driven only by the data-line drive circuit 22 while the other area is driven by both the data-line drive circuit 22 and the data-line auxiliary drive circuit 42. However, the invention is not particularly limited to the case where it is decided whether or not to activate the data-line auxiliary drive circuit 42 based on the line $Y_{300}$ as the boundary. It is desirable to determine the timing of activating the data-line auxiliary drive circuit 40 in consideration of the charge characteristics of the individual pixels.

In the embodiment, it is decided whether or not to activate the data-line auxiliary drive circuit 42 based on a certain time in one frame period as the boundary. This design can reduce the power consumption more than the case of always activating the data-line drive circuit 22 and the data-line auxiliary drive circuit 42 together.

Although the data line auxiliary drive circuit 42 in use has a 4-bit structure whereas the data-line drive circuit 22 in use has an 8-bit structure in the embodiment, a 6-bit or 2-bit data-line auxiliary drive circuit 42 may be used as well. In this case, of 8-bit RGB data signal Da, RGB data signal Da' consisting of upper 6 bits or upper 2 bits, not upper 4 bite, is supplied to the data-line auxiliary drive circuit 42.

In the embodiment, the data-line drive circuit 22 and the data-line auxiliary drive circuit 42 are both used at the timing in one frame period when one line Y is scanned. In the area equivalent to FIG. 16B, however, the data-line auxiliary drive circuit 42 alone may be activated for a given period from $t_1$ to $t_{h1}$ in the selection period t and the data-line drive circuit 22 alone may be activated after time $t_{h1}$ in the selection period t. This modification can also improve the charge characteristic and reduce the power consumption.

The use of the two data-line drive circuits provided to face each other with respect to the liquid crystal panel can overcome the problem such that pixels cannot be charged sufficiently within the selection period due to the parasitic resistance and parasitic capacity.

Fifth Embodiment

Figure 20:
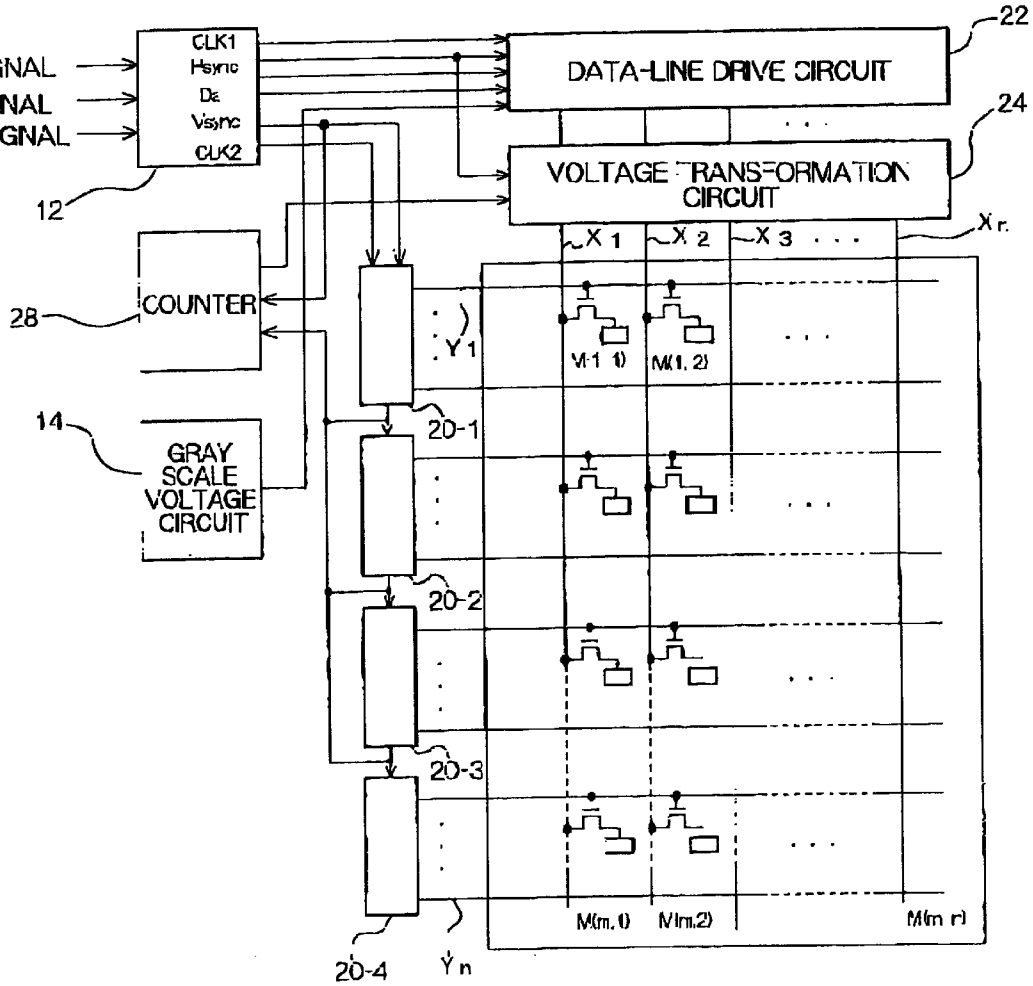
FIG. 20 is a diagram illustrating a liquid crystal device according to a fifth embodiment of the invention.

FIG. 20 illustrates a liquid crystal device that has four line drive circuits 20-1, 20-2, 20-3 and 20-4 connected in series to one another, each of which is an TC, as a modification of the liquid crystal device in FIG. 1. In this case, when line scanning with the line drive circuit 20-1 is finished, an enable signal indicating to that event is sent to a counter 28. The enable signal is counted by the counter 28. Based on the count value, the line drive circuits 20-1, 20-2, 20-3 and 20-4 can supply different data signal voltages to data lines X.

In the case where the line drive circuit 22 in the liquid crystal devices in FIGS. 12 and 15 includes a plurality of line drive circuits, though not illustrated, the line drive circuits can supply different data signal voltages to data lines X based on the count value of the enable signal.

Modification of Counter

In the above-described embodiments, the timing at which the data signal voltage Vd is to be boosted or the timing of activating the data-line auxiliary drive circuit 40 or 42 is determined based on the count value of the counter 26, 27 or 28. Those timings may be determined by a measuring circuit which will be discussed below. A description will now be given referred to FIGS. 17A and 17B below of the structure of a measuring circuit which is provided in place of the counter 26 and the operation of the liquid crystal device that has the measuring circuit.

Figure 17A:
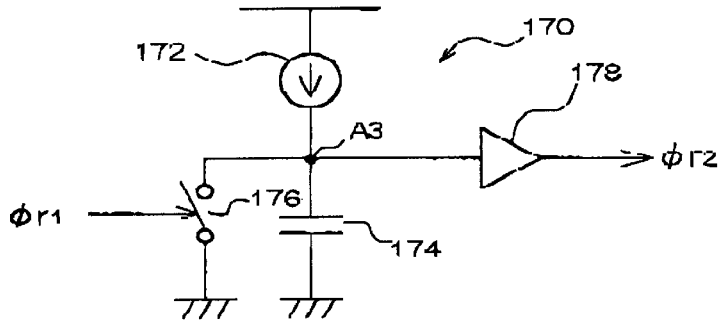
FIG. 17A is a diagram showing a measuring circuit for measuring one frame period and FIG. 17B is a timing chart for explaining the operation of the measuring circuit.
Figure 17B:
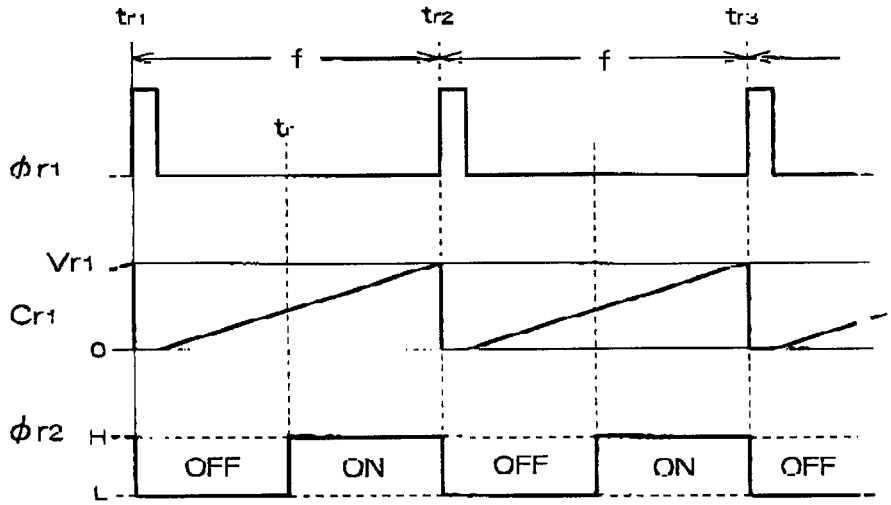

FIG. 17A is a diagram showing the structure of a measuring circuit 170 and FIG. 17B a diagram illustrating a timing chart for the measuring circuit 170.

The measuring circuit 170 in FIG. 17A includes a constant current circuit 172, a capacitor 174, a switching element 176 and a buffer circuit 178. The constant current circuit 172 and the buffer circuit 178 are connected in series to each other. With a node $A_3$ between the constant current circuit 172 and the buffer circuit 178 serving as one end, the capacitor 174 and the switching element 176 are connected in parallel to each other. The other ends of the capacitor 174 and the switching element 176 are grounded. A signal $\phi_{r1}$ is supplied to the switching element 176 in synchronism with the vertical sync signal Vsync that is supplied to the measuring circuit 170 every frame period.

FIG. 17B illustrates a timing chart for the measuring circuit 170. The signal $\phi_{r1}$ supplied based on the vertical sync signal Vsync which corresponds to each frame period f closes the switching element 176, thus discharging charges stored in the capacitor 174. At the same time, the buffer circuit 178 outputs a signal $\phi_{r2}$ having an "L" level. Then, the switching element 176 is opened so that the capacitor 174 is gradually charged in proportional to the time by the constant current circuit 172 as indicated by a waveform $C_{r1}$. At a certain time $t_r$ during the charging, the buffer circuit 178 outputs a signal $\phi_{r2}$ having an "H" level.

The counter 26 is controlled by a digital circuit that counts the input horizontal sync signal Hsync. The measuring circuit 170 shown in FIG. 17A is controlled by an analog circuit which measures the timing at which the capacitor 174 is charged by the constant current circuit 172 and the buffer circuit 178 is enabled. The use of the measuring circuit 170 in place of the counter 26 in FIG. 9 can also change the voltage to be supplied to the data line X in accordance with the distance between the data-line drive circuit 22 which is a voltage supply source and each pixel to be charged. In this case, the voltage transformation circuit 25 is driven for a period from $t_r$ to $t_{r2}$ and the boosted data signal voltage Vd is supplied to the data line X for a given period in the selection period t in the liquid crystal device in FIG. 9. The measuring circuit 170 may also be used in place of the counter 26 or 27 in the liquid crystal device shown in FIG. 9 or FIG. 15 to perform the same control.

Whether or not to boost the data signal voltage Vd can be determined based on the count value of the counter 26. With the use of the measuring circuit 170, whether or not to boost the data signal voltage Vd can similarly be determined by changing the time for the buffer circuit 178 to be turned on Further, changing the time constant $\tau$ of the measuring circuit 170 can change the charge characteristic of the capacitor 174. Furthermore, the timings at which signals of the "H" and "L" levels may be varied by changing the threshold voltage $V_{th}$ of each of the switching elements constituting the buffer circuit 170 in the measuring circuit 170.

As apparent from the above, the use of the measuring circuit 170 can adequately set the time T for the capacitor to be charged in one frame period. Using this timing, the voltage transformation circuit 25 can change the voltage of the data signal applied around the time T.

Although the measuring circuit 170 in FIG. 17 uses a single buffer circuit 178 to set two periods, the period from $t_{r1}$ to $t_r$ and the period from $t_r$ to $t_{r2}$, a plurality of buffer circuits may be provided to set a plurality of periods.

Figure 19A:
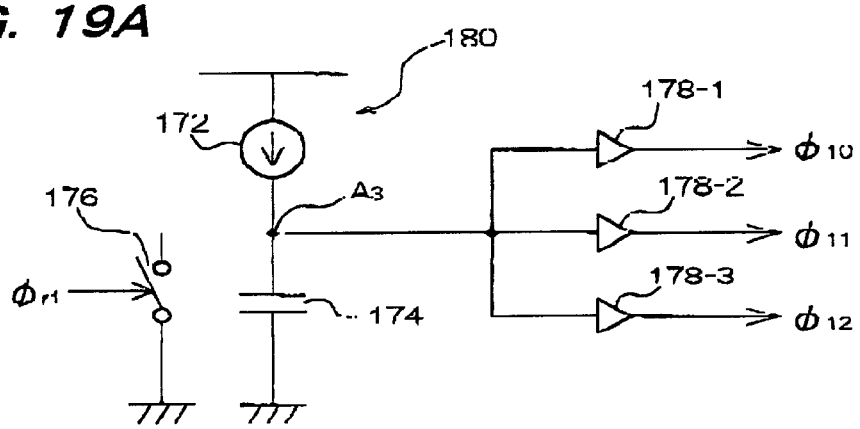
FIG. 19A is a circuit diagram showing another measuring circuit which has a plurality of buffer circuits connected in parallel to the measuring circuit in FIG. 17.
Figure 19B:
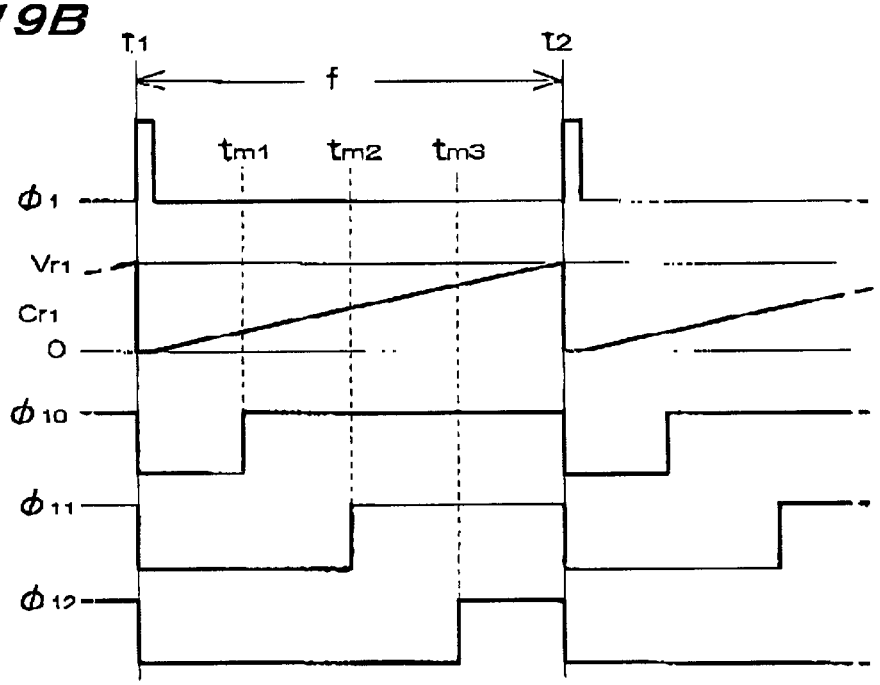
FIG. 19B is a diagram showing a timing chart for that measuring circuit.

For example, a measuring circuit 180 in FIG. 19A has three buffer circuits 178-1, 178-2 and 178-3 connected in parallel to one another with the node $A_3$ as one end. Logical signals $\phi$10 to $\phi$12 from the buffer circuits 178-1, 178-2 and 178-3 are set in such a way that timings of outputting the logical outputs are different from one another as shown in FIG. 19B. In the example of FIG. 19A, an appropriate combination of an NAND gate or NOR gate with the logical output of each of the buffer circuits 178-1, 178-2 and 178-3 makes it possible to determine the timing of adding a voltage onto the data signal voltage Vd.

The structure of the measuring circuit 180 can set four periods from $t_1$ to $t_{m1}$, from $t_{m1}$ to $t_{m2}$, from $t_{m2}$ to $t_{m3}$ and from $t_{m3}$ to $t_2$. In FIG. 9, for example, the charge characteristic of each pixel selected can be improved by changing the voltage of the data signal supplied from the data-line drive circuit 22 by the voltage transformation circuit 25 in each of those four periods.

The invention is not limited to the embodiments, but may be modified in various other forms within the scope of the invention. For example, the application of the invention is not limited to the driving of the TFT liquid crystal device, but the invention is applicable to a passive matrix type image display device and an image display device which uses a display using TFDs (Thin Film Diodes) each constituted by a 2-end element, an electroluminescence (EL) display of a plasma display.

The invention can be applied to various kinds of electronic instruments, such as a cell phone, a game machine, an electronic note, a personal computer, a word processor, a TV and a car navigation system.

What is claimed is:

1. An electro-optical device comprising:

a scan-line drive circuit which supplies a scan signal to a plurality of scan lines for selecting one of the scan lines;

a data-line drive circuit which supplies a data signal to a plurality of data lines; and a voltage transformation circuit which changes a voltage of the data signal supplied from the data-line drive circuit based on a distance between the data-line drive circuit and one of the scan lines which has been sequentially selected by the scan-line drive circuit.

2. The electro-optical device as defined in claim 1, wherein the voltage transformation circuit includes:

a transformation-period determination circuit which determines a transformation period in which the voltage of the data signal from the data-line drive circuit is changed, within the charge period;

a voltage generation circuit which generates a voltage; and a voltage addition circuit which adds the voltage generated by the voltage generation circuit to the voltage of the data signal supplied from the data-line drive circuit within the transformation period.

3. The electro-optical device as defined in claim 2, wherein the transformation-period determination circuit includes:

a first constant current source;

a first capacitor which has one end connected to the first constant current source and the other end connected to a terminal having an arbitrary potential;

a first switching element connected in parallel to the first capacitor; and a first buffer having an input terminal connected between the first constant current source and the first capacitor, wherein the first switching element is closed in synchronism with the end of the charge period to discharge the first capacitor;

wherein the first switching element is opened in synchronism with a start of the charge period to charge the first capacitor; and wherein the transformation period is determined based on a logical output of the first buffer.

4. The electro-optical device as defined in claim 3, wherein the transformation-period determination circuit changes the transformation period.

5. The electro-optical device as defined in claim 2, wherein the data signal having a higher voltage boosted by the voltage transformation circuit is supplied to each of the data lines when the distance between the data-line drive circuit and one of the scan lines selected by the scan-line drive circuit is longer.

6. The electro-optical device as defined in claim 5, wherein the voltage generation circuit includes:

a second constant current source;

a second capacitor which has one end connected to the second constant current source and the other end connected to a terminal having an arbitrary potential; and a second switching element connected in parallel to the second capacitor, wherein the voltage addition circuit adds a voltage of the second capacitor to the voltage of the data signal supplied every charge period from the data-line drive circuit.

7. The electro-optical device as defined in claim 6, wherein the voltage addition circuit includes a circuit which converts the voltage of the second capacitor with an arbitrary function.

8. The electro-optical device as defined in claim 7, wherein the arbitrary function is a function of the voltage of the data signal supplied from the data-line drive circuit.

9. The electro-optical device as defined in claim 1, further comprising:

a counter which counts a plurality of scan lines which have been selected within one frame period from start to end by the scan-line drive circuit, wherein the voltage transformation circuit changes the voltage of the data signal supplied from the data-line drive circuit, based on a value counted by the counter.

10. The electro-optical device as defined in claim 1, further comprising:

a measuring circuit which measures elapsed time every one frame period, wherein the measuring circuit includes:

a third constant current source;

a third capacitor which has one end connected to the third constant current source and the other end connected to a terminal having an arbitrary potential;

a third switching element connected in parallel to the third capacitor; and a second buffer having an input terminal connected between the third constant current source and the third capacitor, wherein the third switching element is closed in synchronism with the end of one frame period to discharge the third capacitor;

wherein the third switching element is opened in synchronism with a start of one frame period to charge the third capacitor; and wherein the voltage transformation circuit changes the voltage of the data signal supplied from the data-line drive circuit, based on a logical output of the second buffer.

11. The electro-optical device as defined in claim 10, wherein:

the measuring circuit includes a plurality of third buffers connected in parallel with the input terminal as a common end;

the third buffers have different switch timings for logical outputs; and the voltage transformation circuit changes the voltage of the data signal supplied from the data-line drive circuit, based on each of the logical outputs of the third buffers.

12. The electro-optical device as defined in claim 1, wherein:

the scan-line drive circuit comprises a plurality of integrated circuits (ICs) for scan-line drive; and the voltage transformation circuit changes the voltage of the data signal supplied from the data-line drive circuit for each of the ICs for scan-line drive.

13. An electronic instrument having the electro-optical device as defined in claim 1.

14. An electro-optical device comprising:

a scan-line drive circuit which supplies a scan signal to a plurality of scan lines for selecting one of the scan lines;

a first data-line drive circuit which supplies a first data signal to one end of each of a plurality of data lines;

a second data-line drive circuit which supplies a second data signal to the other end of each of the plurality of data lines; and a circuit which caused the second data-line drive circuit to supply the second data signal to each of the data lines in synchronism with the supply of the first data signal to each of the data lines, wherein the second data signal is set to have a lower accuracy of gray scale display in comparison with the first data signal.

15. An electronic instrument having the electro-optical device as defined in claim 14.

16. An electro-optical device comprising:

a scan-line drive circuit which supplies a scan signal to a plurality of scan lines for selecting one of the scan lines;

a first data-line drive circuit which supplies a first data signal to one end of each of a plurality of data lines;

a second data-line drive circuit which supplies a second data signal to the other end of each of the plurality of data lines; and a voltage transformation circuit which changes a voltage of the second data signal supplied from the second data-line drive circuit based on a distance between the first data-line drive circuit and one of the scan lines which has been sequentially selected by the scan-line drive circuit.

17. The electro-optical device as defined in claim 16, wherein the second data signal is set to have a lower accuracy of gray scale display in comparison with the first data signal.

18. An electronic instrument having the electro-optical device as defined in claim 16.

19. A method of driving an electro-optical device, comprising the steps of:

causing a scan-line drive circuit to supply a scan signal to each of scan lines for selecting one of the scan lines;

causing a data-line drive circuit to supply a data signal to each of data lines;

changing a voltage of the data signal supplied from the data-line drive circuit, based on a distance between the data-line drive circuit and one of the scan lines which has been sequentially selected by the scan-line drive circuit; and supplying a voltage to each of pixels based on the data signal and charging each of the pixels to a predetermined voltage within a predetermined charge period, the pixels being formed of an electro-optical material and provided to correspond to intersections of the scan lines and the data lines.

20. A method of driving an electro-optical device, comprising the steps of:

causing a scan-line drive circuit to supply a scan signal to each of scan lines for selecting one of the scan lines;

causing a first data-line drive circuit to supply a first data signal to one end of each of data lines;

causing a second data-line drive circuit to supply a second data signal to the other end of each of the data lines in synchronism with the supply of the first data signal to each of the data lines; and supplying a voltage to each of pixels based on the first and second data signals and charging each of the pixels to a predetermined voltage within a predetermined charge period, the pixels being formed of an electro-optical material and provided to correspond to intersections of the scan lines and the data lines, wherein the second data signal is set to have a lower accuracy of gray scale display in comparison with the first data signal.

21. A method of driving an electro-optical device, comprising the steps of:

causing a scan-line drive circuit to supply a scan signal to each of scan lines for selecting one of the scan lines;

causing a first data-line drive circuit to supply a first data signal to one end of each of data lines;

causing a second data-line drive circuit to supply a second data signal to the other end of each of the data lines;

changing a voltage of the second data signal supplied from the second data-line drive circuit to each of the data lines, based on a distance between the first data-line drive circuit and one of the scan lines which has been sequentially selected by the scan-line drive circuit; and supplying a voltage to each of pixels based on the first and second data signals and charging each of the pixels to a predetermined voltage within a predetermined charge period, the pixels being formed of an electro-optical material and provided to correspond to intersections of the scan lines and the data lines.

22. The method according to claim 19 further comprising the step of determining a transformation period in which the voltage of the data signal from the data-line drive circuit is changed by a transformation-period determination circuit.

23. The method according to claim 22 wherein the determining step further comprises the steps of:

generating a voltage; and adding the generated voltage to the voltage of the data signal supplied from the data-line drive circuit within the transformation period.

24. The method according to claim 22 further comprising the step of changing the transformation by the transformation-period determination circuit.

25. The method according to claim 21 further comprising the step of supplying the data signal having a higher voltage boosted by the voltage transformation circuit to each of the data lines when the distance between the data-line drive circuit and one of the scan limes selected by the scan-line drive circuit is longer.

26. The method according to claim 23, wherein the adding the generated voltage step further comprises adding a voltage of a capacitor to the voltage of the data signal supplied every charge period from the data-line drive circuit.

27. The method according to claim 26, wherein the adding the generated voltage step further comprises converting a voltage of the capacitor with an arbitrary function.

28. The method according to claim 21 further comprising the steps of:

counting a plurality of scan lines which have been selected within one frame period from start to end; and changing the voltage of the data signal supplied from the data-line drive circuit based on a value counted.

29. The method according to claim 21 further comprising the step of changing the voltage of the data signal supplied from the data-line drive circuit for each of a plurality of integrated circuits (ICs).

* * * * *